US011029615B2

(12) United States Patent
Mitsui et al.

(10) Patent No.: US 11,029,615 B2
(45) Date of Patent: Jun. 8, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Takahiro Mitsui, Kawasaki (JP); Koichi Nakata, Tokyo (JP); Haruki Mori, Nagareyama (JP); Shubun Kujirai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/936,508

(22) Filed: Jul. 23, 2020

(65) Prior Publication Data

US 2021/0033991 A1 Feb. 4, 2021

(30) Foreign Application Priority Data

Jul. 29, 2019 (JP) ..... JP2019-138967

(51) Int. Cl.
*G03G 5/147* (2006.01)
*G03G 5/06* (2006.01)
(Continued)

(52) U.S. Cl.
CPC ..... *G03G 5/0638* (2013.01); *G03G 5/047* (2013.01); *G03G 5/064* (2013.01); *G03G 15/75* (2013.01); *G03G 21/1814* (2013.01)

(58) Field of Classification Search
CPC ..... G03G 5/14752; G03G 5/14756; G03G 5/1476; G03G 5/14769; G03G 5/076; G03G 5/07; G03G 5/075; G03G 5/0764; G03G 5/0763; G03G 5/0766; G03G 5/056; G03G 5/0564; G03G 5/0567; G03G 5/0571
See application file for complete search history.

(56) References Cited

U.S. PATENT DOCUMENTS 7,186,489 B2 3/2007 Uematsu et al.
7,226,711 B2 6/2007 Amamiya et al.
(Continued)

FOREIGN PATENT DOCUMENTS

JP 06-308756 * 11/1994 ..... G03G 5/147
JP 2000-206724 * 7/2000 ..... G03G 5/147
(Continued)

OTHER PUBLICATIONS

Translation of JP 2000-206724.*
Translation of JP 06-308756.*

*Primary Examiner* — Peter L Vajda
(74) *Attorney, Agent, or Firm* — Venable LLP

(57) ABSTRACT

Provided is an electrophotographic photosensitive member improved both in wear resistance and in image unevenness. The electrophotographic photosensitive member includes a support, and a photosensitive layer and a surface layer on the support, wherein the surface layer is a cured product of a composition containing a compound represented by the formula (A) and a charge-transporting substance having at least one reactive functional group selected from the group consisting of a hydroxy group, a methoxy group, an amino group, a thiol group, and a carboxyl group.

7 Claims, 1 Drawing Sheet

(51) Int. Cl.

| | |
|---|---|
| ***G03G 5/047*** | (2006.01) |
| ***G03G 15/00*** | (2006.01) |
| ***G03G 21/18*** | (2006.01) |

(56) References Cited

U.S. PATENT DOCUMENTS

| | | | |
|---|---|---|---|
| 7,444,097 | B2 | 10/2008 | Suzuki et al. |
| 7,534,534 | B2 | 5/2009 | Nakata et al. |
| 9,316,931 | B2 | 4/2016 | Takagi et al. |
| 9,389,523 | B2 | 7/2016 | Nakata et al. |
| 9,594,318 | B2 | 3/2017 | Nakata et al. |
| 9,740,117 | B2 | 8/2017 | Kosaka et al. |
| 10,042,272 | B2 | 8/2018 | Mori et al. |
| 10,120,331 | B2 | 11/2018 | Nakata et al. |
| 10,310,395 | B2 | 6/2019 | Nakata et al. |
| 10,365,569 | B2 | 7/2019 | Tokimitsu et al. |
| 10,451,984 | B2 | 10/2019 | Mori et al. |
| 10,488,769 | B2 | 11/2019 | Nakata et al. |
| 10,488,771 | B2 | 11/2019 | Mori et al. |
| 10,558,132 | B2 | 2/2020 | Ishiduka et al. |
| 10,558,133 | B2 | 2/2020 | Nakamura et al. |
| 10,670,979 | B2 | 6/2020 | Nakata et al. |
| 10,761,442 | B2 | 9/2020 | Nakata et al. |
| 10,768,539 | B2 | 9/2020 | Mori et al. |
| 2019/0369514 | A1 | 12/2019 | Watanabe et al. |
| 2020/0159136 | A1 | 5/2020 | Mori et al. |
| 2020/0201200 | A1 | 6/2020 | Tokimitsu et al. |
| 2020/0218171 | A1 | 7/2020 | Takeuchi et al. |
| 2020/0249590 | A1 | 8/2020 | Nakata et al. |
| 2020/0341391 | A1 | 10/2020 | Tokimitsu et al. |
| 2020/0341394 | A1 | 10/2020 | Ikari et al. |

FOREIGN PATENT DOCUMENTS

| | | |
|---|---|---|
| JP | 2006-008805 | 1/2006 |
| JP | 3740389 | 2/2006 |
| JP | 4021712 | 12/2007 |
| JP | 2009-031721 | 2/2009 |
| JP | 2016-009078 | 1/2016 |

* cited by examiner

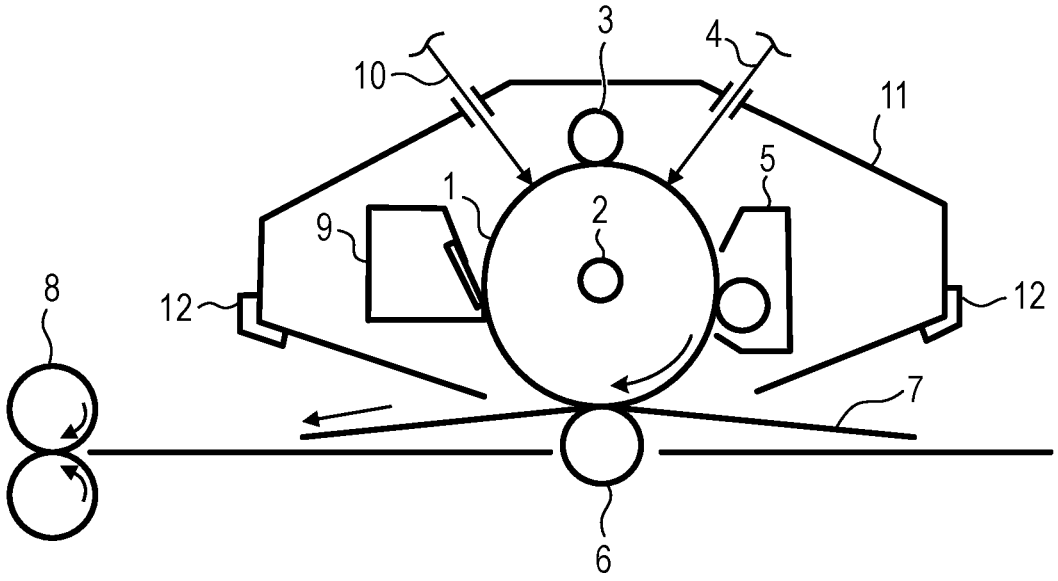
3
4
10
11
5
1
2
9
8
12
12
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus each including the electrophotographic photosensitive member.

Description of the Related Art

A surface layer of an electrophotographic photosensitive member is subjected to stress due to a series of processes, such as charging, exposure, development, transfer, and cleaning, and hence is required to have wear resistance and chemical stability.

As a technology for improving the wear resistance, in Japanese Patent No. 3740389, there is a disclosure of a technology involving using, for a surface layer, a curable resin formed from a monomer having a charge-transporting property.

In addition, when the chemical stability is poor, image unevenness occurs. One of the causes of the image unevenness is a pause memory. The pause memory is a phenomenon in which, while an electrophotographic apparatus is paused, a discharge product acts on part of the electrophotographic photosensitive member opposed to a charging member to alter the photosensitive member, resulting in image unevenness at the time of next image output. As a technology for improving the chemical stability, in Japanese Patent Application Laid-Open No. 2009-31721, there is a disclosure of a technology involving suppressing adsorption of the discharge product through use of a guanamine compound having a hydrophobic group.

An investigation made by the inventors has found that the electrophotographic photosensitive members described in Japanese Patent No. 3740389 and Japanese Patent Application Laid-Open No. 2009-31721 have certain effects on improving the wear resistance, but have room for improvement in terms of image unevenness due to the pause memory.

SUMMARY OF THE INVENTION

Therefore, an object of the present disclosure is to provide an electrophotographic photosensitive member improved both in wear resistance and in image unevenness.

The above-mentioned object can be achieved by the present disclosure described below. That is, according to at least one embodiment of the present disclosure, there is provided an electrophotographic photosensitive member including: a support; a photosensitive layer; and a surface layer, the photosensitive layer and the surface layer being arranged on the support, wherein the surface layer is a cured product of a composition containing: a compound represented by the formula (A); and a charge-transporting substance having at least one reactive functional group selected from the group consisting of a hydroxy group, a methoxy group, an amino group, a thiol group, and a carboxyl group:

(A)

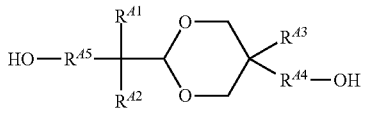

in the formula (A), $R^{A1}$ and $R^{A2}$ each independently represent an alkyl group having 1 or more and 4 or less carbon atoms, or a substituted or unsubstituted phenyl group, $R^{A1}$ and may be bonded to each other to form a ring, $R^{A3}$ represents an alkyl group having 1 or more and 4 or less carbon atoms, and $R^{A4}$ and $R^{A5}$ each represent an alkylene group having 1 or more and 4 or less carbon atoms.

Further features of the present invention will become apparent from the following description of exemplary embodiments with reference to the attached drawing.

BRIEF DESCRIPTION OF THE DRAWINGS

FIG. 1 is a view for illustrating an example of a schematic configuration of an electrophotographic apparatus including a process cartridge including an electrophotographic photosensitive member.

DESCRIPTION OF THE EMBODIMENTS

The present disclosure is described in detail below by way of exemplary embodiments.

In an investigation made by the inventors, the technologies described in Japanese Patent No. 3740389 and Japanese Patent Application Laid-Open No. 2009-31721 each caused image unevenness due to a pause memory. In Japanese Patent No. 3740389, a cured product of a composition formed of a charge-transportable monomer and a phenol resin is used, but a function of suppressing the action of a discharge product is not imparted thereto. In Japanese Patent Application Laid-Open No. 2009-31721, a cured product of a composition formed of a charge-transportable monomer and a guanamine compound having a hydrophobic group is used, and a function of suppressing the adsorption of a discharge product is imparted thereto by the hydrophobic group, but the effect is insufficient for suppressing the occurrence of the pause memory.

In order to solve the problem that has occurred in the related art, the inventors have investigated kinds of materials for a surface layer. For the suppression of the action exhibited by the discharge product, there are given a method involving making the discharge product harmless through use of an antioxidant or the like, and a method involving suppressing the adsorption and permeation of the discharge product through use of a material having high gas barrier properties. However, when the antioxidant or the material having high gas barrier properties is merely mixed, there is a concern that the wear resistance of the surface layer may be reduced. Therefore, it is preferred to use a material that is integrated with the cured product through polymerization, but as in the technology of Japanese Patent Application Laid-Open No. 2009-31721, the effect obtained by the introduction of a hydrophobic group is limited.

As a result of the investigation on the kinds of materials, it has been found that improvements in wear resistance and image unevenness can both be achieved when the surface layer is formed of a cured product of a composition containing a compound represented by the formula (A) and a charge-transporting substance (hereinafter sometimes referred to as "charge-transportable monomer") having at least one reactive functional group selected from the group consisting of a hydroxy group, a methoxy group, an amino group, a thiol group, and a carboxyl group.

The mechanism of at least one embodiment of the present disclosure is considered to be as follows: the compound represented by the formula (A) is copolymerized into the cured product of the composition containing the charge-transportable monomer, which has high wear resistance, and thus film denseness is increased, with the result that gas barrier properties and wear resistance are both achieved. At least one embodiment of the present disclosure has the following two features: the compound represented by the formula (A) and the charge-transportable monomer have specific substituents that are copolymerizable; and the compound represented by the formula (A) has a moderately small molecular weight relative to the charge-transportable monomer. By virtue of those features, an intermolecular distance can be reduced to increase the film denseness as compared to a cured product obtained by polymerizing the charge-transportable monomer alone. In order to reduce the intermolecular distance, it is desirable that the molecular weight of the compound represented by the formula (A) be as small as possible. However, when the molecular weight is excessively small, the compound cannot be copolymerized with the charge-transportable monomer, and hence the effect of at least one embodiment of the present disclosure is not obtained. In at least one embodiment of the present disclosure, the effect is achieved not by merely copolymerizing compounds having functions, but by appropriately combining two compounds.

The compound represented by the formula (A) is described.

(A)

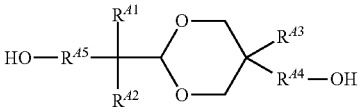

$R^{A1}$ and $R^{A2}$ each independently represent an alkyl group having 1 or more and 4 or less carbon atoms, or a substituted or unsubstituted phenyl group. A substituent on the phenyl group is an alkyl group having 1 or more and 4 or less carbon atoms. In addition, $R^{A3}$ represents an alkyl group having 1 or more and 4 or less carbon atoms.

Examples of the alkyl group having 1 or more and 4 or less carbon atoms include a methyl group, an ethyl group, a n-propyl group, an isopropyl group, a n-butyl group, an isobutyl group, a sec-butyl group, and a tert-butyl group. When $R^{A1}$ and $R^{A2}$ are bonded to each other to form a ring, examples of the ring include a cyclopentane ring, a cyclohexane ring, and a cycloheptane ring. $R^{A1}$ and $R^{A2}$ each preferably represent an alkyl group having 1 or more and 4 or less carbon atoms.

$R^{A3}$ preferably represents a methyl group or an ethyl group in terms of the number of carbon atoms.

$R^{A4}$ and $R^{A5}$ each represent an alkylene group having 1 or more and 4 or less carbon atoms. $R^{A4}$ and $R^{A5}$ each preferably represent a methylene group or an ethylene group.

Compounds represented by the formula (A-1) to the formula (A-22) are shown as exemplary compounds of the compound represented by the formula (A). However, the compound represented by the formula (A) is not limited to these exemplary compounds.

(A-1)

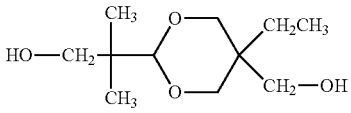

(A-2)

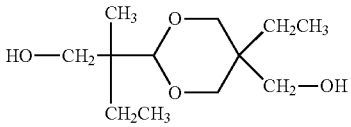

(A-3)

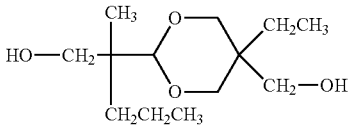

(A-4)

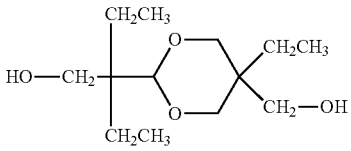

(A-5)

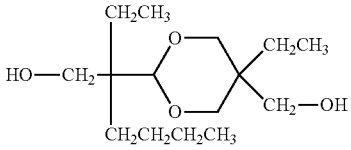

(A-6)

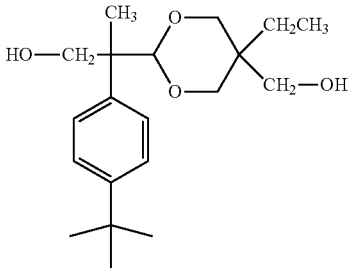

(A-7)

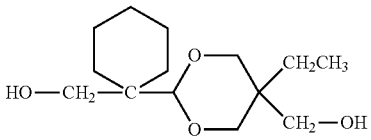

(A-8)

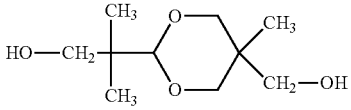

(A-9)

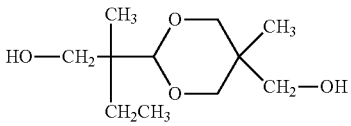

(A-10)

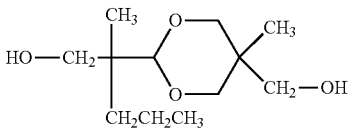

-continued (A-11)

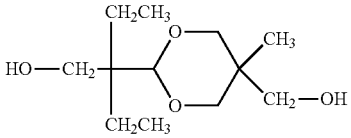

(A-12)

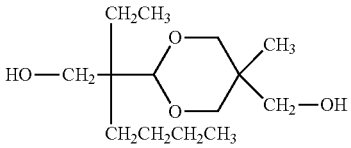

(A-13)

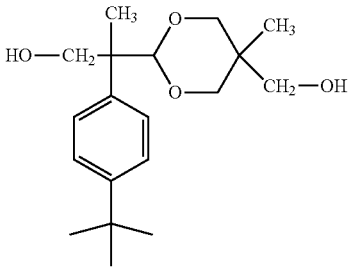

(A-14)

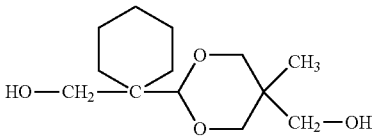

(A-15)

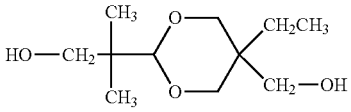

(A-16)

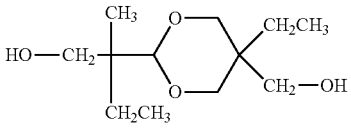

(A-17)

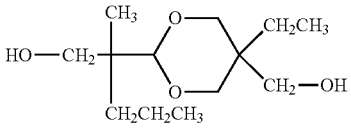

(A-18)

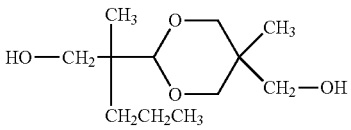

(A-19)

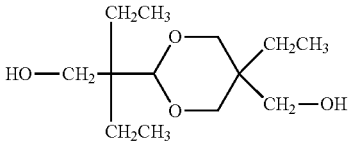

(A-20)

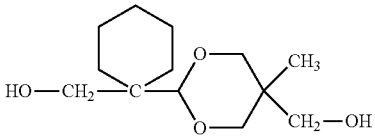

-continued (A-21)

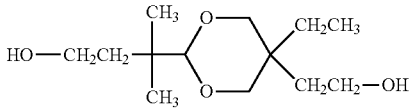

(A-22)

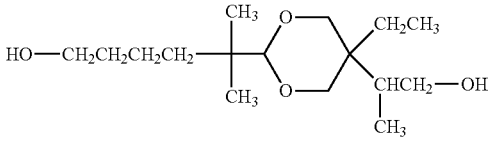

Synthesis Example

A synthesis example of the compound represented by the formula (A-3) is described.

Reaction formula (1)

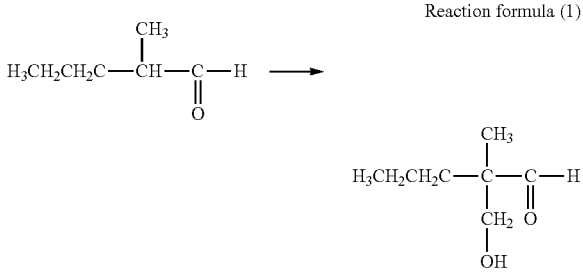

50 Parts of 2-methylvaleraldehyde, 40.5 parts of 37% formaldehyde, and 8.5 parts of benzyltrimethylammonium hydroxide (40% aqueous solution) were mixed in an autoclave. A nitrogen gas was injected to increase the pressure to 0.5 MPa, and the mixture was stirred at 90° C. for 1 hour to perform a reaction as shown in the reaction formula (1). After the completion of the reaction, the reaction liquid was cooled to room temperature, and subjected to liquid separation. Washing with water and concentration gave about 50 parts of a colorless liquid.

Reaction formula (2)

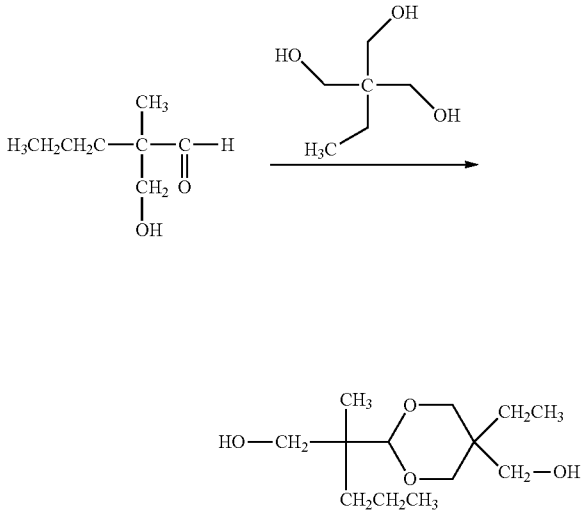

50 Parts of the colorless liquid, 52 parts of trimethylolpropane, and 1 part of p-toluenesulfonic acid were mixed, and the mixture was stirred at room temperature overnight to perform a reaction as shown in the reaction formula (2). After the completion of the reaction, the reaction product was purified by column chromatography using ethyl acetate as a mobile phase and using silica gel, to give about 30 parts of the compound represented by the formula (A-3) as a colorless oil.

Other compounds represented by the formula (A) may also be synthesized by similar methods.

Next, the charge-transporting substance (charge-transportable monomer) having at least one reactive functional group selected from the group consisting of a hydroxy group, a methoxy group, an amino group, a thiol group, and a carboxyl group is described. The charge-transportable monomer has a feature of having a substituent polymerizable with the compound represented by the formula (A). The charge-transportable monomer is preferably a charge-transportable monomer having a hydroxy group. Of the charge-transportable monomers each having a hydroxy group, a charge-transportable monomer having at least one group selected from the group consisting of a hydroxyalkyl group, a hydroxyalkoxy group, and a hydroxyphenyl group that may have a substituent is particularly preferred.

As examples of the charge-transportable monomer, examples of the charge-transportable monomer having a hydroxy group are represented by the formulae (1) to (6) below.

(1)

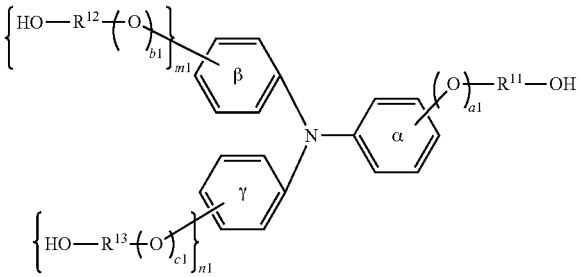

In the formula (1), $R^{11}$, $R^{12}$, and $R^{13}$ each represent an optionally branched alkylene group having 1 or more and 8 or less carbon atoms. "α", "β", and "γ" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. a1, b1, and c1 each represent 0 or 1, and m1 and n1 each represent 0 or 1.

(2)

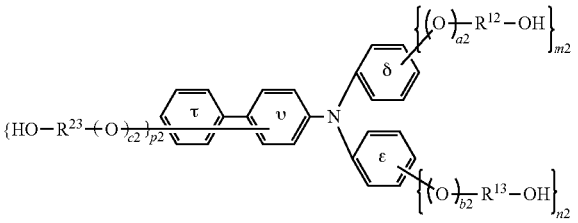

In the formula (2), $R^{21}$, $R^{22}$, and $R^{23}$ each represent an optionally branched alkylene group having 1 or more and 8 or less carbon atoms. "δ" and "ε" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. a2, b2, and c2 each represent 0 or 1. m2, n2, and p2 each represent 0 or 1, but do not simultaneously represent 0. "τ" and "υ" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. "τ" and "υ" may together form a ring via a substituent.

(3)

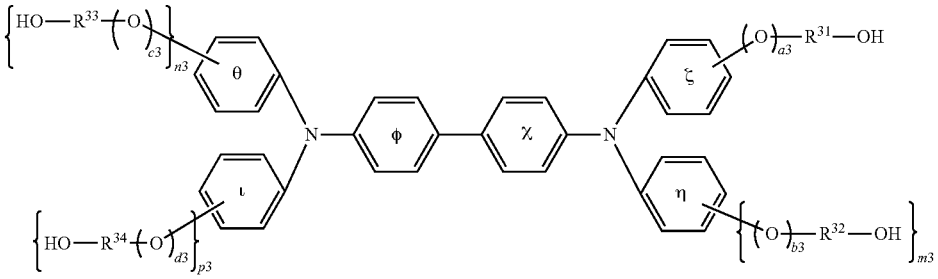

In the formula (3), $R^{31}$, $R^{32}$, $R^{33}$, and $R^{34}$ each represent an optionally branched alkylene group having 1 or more and 8 or less carbon atoms. "ζ", "η", "θ", and "ι" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. a3, b3, c3, and d3 each represent 0 or 1. m3, n3, and p3 each represent 0 or 1, but do not simultaneously represent 0. "φ" and "χ" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. "φ" and "χ" may together form a ring via a substituent.

Examples of the optionally branched alkylene group having 1 or more and 8 or less carbon atoms represented by each of $R^{11}$ to $R^{13}$, $R^{21}$ to $R^{23}$, and $R^{31}$ to $R^{34}$ include a methylene group, an ethylene group, a propylene group, and a butylene group.

Specific examples of the substituent that the benzene ring represented by each of "α", "β", "γ", "δ", "ε", "ζ", "η", "θ", and "ι" may have include the following substituents. Examples of the halogen atom serving as the substituent include fluorine, chlorine, bromine, and iodine. Examples of the alkyl group serving as the substituent, which may have a substituent, include a methyl group, an ethyl group, a propyl group, and a butyl group. Examples of the alkoxy group serving as the substituent, which may have a substituent, include a methoxy group, an ethoxy group, a propoxy group, and a butoxy group. Examples of the aryl group serving as the substituent, which may have a substituent, include a phenyl group, a naphthyl group, an anthryl group, and a pyrenyl group. Examples of the heterocyclic group serving as the substituent, which may have a substituent, include a pyridyl group, a thienyl group, a furyl group, and a quinolyl group.

Specific examples of the substituent that the benzene ring represented by each of "τ", "υ", "φ", and "χ" may have include the following substituents. Examples of the halogen atom serving as the substituent include fluorine, chlorine, bromine, and iodine. Examples of the alkyl group serving as the substituent, which may have a substituent, include a methyl group, an ethyl group, a propyl group, and a butyl group. Examples of the alkoxy group serving as the substituent, which may have a substituent, include a methoxy group, an ethoxy group, a propoxy group, and a butoxy group. Examples of the aryl group serving as the substituent, which may have a substituent, include a phenyl group, a naphthyl group, an anthryl group, and a pyrenyl group. Examples of the heterocyclic group serving as the substituent, which may have a substituent, include a pyridyl group, a thienyl group, a furyl group, and a quinolyl group. Examples of each of the ring that "τ" and "υ" together form via a substituent, and the ring that "φ" and "χ" together form via a substituent include a fluorene skeleton and a dihydrophenanthrene skeleton.

Examples of the substituent in each of the alkyl group that may have a substituent, the alkoxy group that may have a substituent, the aryl group that may have a substituent, and the heterocyclic group that may have a substituent include: alkyl groups, such as a methyl group, an ethyl group, a propyl group, and a butyl group; aralkyl groups, such as a benzyl group, a phenethyl group, and a naphthylmethyl group; aromatic ring groups, such as a phenyl group, a naphthyl group, an anthryl group, a pyrenyl group, a fluorenyl group, a carbazolyl group, a dibenzofuryl group, and a dibenzothiophenyl group; alkoxy groups, such as a methoxy group, an ethoxy group, and a propoxy group; aryloxy groups, such as a phenoxy group and a naphthoxy group; halogen atoms, such as fluorine, chlorine, bromine, and iodine; and a nitro group or a cyano group.

(4)

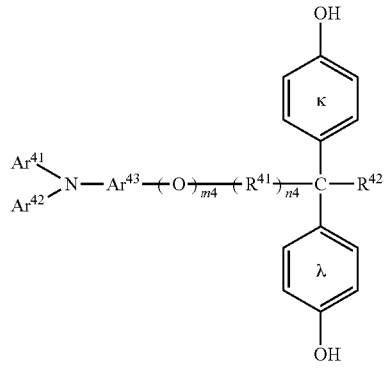

In the formula (4), $R^{41}$ represents an optionally branched alkylene group having 1 or more and 8 or less carbon atoms, and $R^{42}$ represents a hydrogen atom, an alkyl group that may have a substituent, an aralkyl group that may have a substituent, or a phenyl group that may have a substituent. $Ar^{41}$ and $Ar^{42}$ each represent an aryl group that may have a substituent, or a heterocyclic group that may have a substituent. $Ar^{43}$ represents an arylene group that may have a substituent, or a divalent heterocyclic group that may have a substituent. m4 and n4 each represent 0 or 1, provided that, when n4=0, m4=0. "κ" and "λ" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent.

(5)

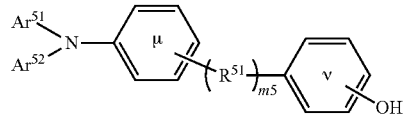

In the formula (5), $R^{51}$ represents an optionally branched divalent hydrocarbon group having 1 or more and 8 or less carbon atoms. $Ar^{51}$ and $Ar^{52}$ each represent an aryl group that may have a substituent, or a heterocyclic group that may have a substituent. "μ" and "ν" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. "μ" and "ν" may together form a ring via a substituent. m5 represents 0 or 1.

(6)

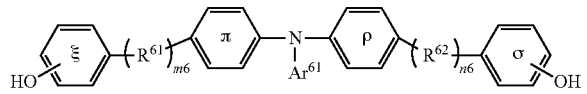

In the formula (6), $R^{61}$ and $R^{62}$ each represent an optionally branched alkylene group having 1 or more and 8 or less carbon atoms. $Ar^{61}$ represents an aryl group that may have a substituent, or a heterocyclic group that may have a substituent. "ξ", "π", "ρ", and "σ" each represent a benzene ring that may have, as a substituent, one or more of: a halogen atom; an alkyl group that may have a substituent; an alkoxy group that may have a substituent; an aryl group that may have a substituent; and a heterocyclic group that may have a substituent. "ξ" and "π" may together form a ring via a substituent, and "ρ" and "σ" may together form a ring via a substituent. m6 and n6 each represent 0 or 1.

Examples of the optionally branched alkylene group having 1 or more and 8 or less carbon atoms represented by each of $R^{41}$, $R^{51}$, $R^{61}$, and $R^{62}$ include a methylene group, an ethylene group, a propylene group, and a butylene group. Examples of the alkyl group that may have a substituent represented by $R^{42}$ include a methyl group, an ethyl group, a propyl group, and a butyl group, examples of the aralkyl group that may have a substituent represented by $R^{42}$ include a benzyl group, a phenethyl group, and a naphthylmethyl group, an example of the aryl group that may have a substituent represented by $R^{42}$ is a phenyl group, and examples of the heterocyclic group that may have a substituent represented by $R^{42}$ include a pyridyl group, a thienyl group, a furyl group, and a quinolyl group.

Specific examples of the substituent that the benzene ring represented by each of "κ", "λ", "μ", "ν", "ξ", "ρ", and "σ" in the formulae may have include the following substituents. Examples of the halogen atom serving as the substituent include fluorine, chlorine, bromine, and iodine. Examples of the alkyl group serving as the substituent, which may have a substituent, include a methyl group, an ethyl group, a propyl group, and a butyl group. Examples of the alkoxy group serving as the substituent, which may have a substituent, include a methoxy group, an ethoxy group, a propoxy group, and a butoxy group. Examples of the aryl group serving as the substituent, which may have a substituent, include a phenyl group, a naphthyl group, an anthryl group, and a pyrenyl group. Examples of the heterocyclic group serving as the substituent, which may have a substituent, include a pyridyl group, a thienyl group, a furyl group, and a quinolyl group. In addition, examples of each of the ring that "μ" and "ν" together form via a substituent, the ring that "ξ" and "π" together form via a substituent, and the ring that "ρ" and "σ" together form via a substituent include a fluorene skeleton and a dihydrophenanthrene skeleton.

In each of $Ar^{41}$, $Ar^{42}$, $Ar^{51}$, $Ar^{52}$, and $Ar^{61}$, examples of the alkyl group of the alkyl group that may have a substituent include a methyl group, an ethyl group, a propyl group, and a butyl group. Examples of the aralkyl group of the aralkyl group that may have a substituent include a benzyl group, a phenethyl group, and a naphthylmethyl group. Examples of the aryl group of the aryl group that may have a substituent include a phenyl group, a naphthyl group, an anthryl group, and a pyrenyl group. Examples of the heterocyclic group of the heterocyclic group that may have a substituent include a pyridyl group, a thienyl group, a furyl group, and a quinolyl group.

Examples of the arylene group of the arylene group that may have a substituent represented by $Ar^{43}$ include a phenylene group, a naphthylene group, an anthrylene group, and a pyrenylene group, and examples of the heterocyclic group of the divalent heterocyclic group that may have a substituent represented by $Ar^{43}$ include a pyridylene group and a thienylene group.

Examples of the substituent in each of the alkyl group that may have a substituent, the alkoxy group that may have a substituent, the aryl group that may have a substituent, the aralkyl group that may have a substituent, the heterocyclic group that may have a substituent, the arylene group that may have a substituent, and the divalent heterocyclic group that may have a substituent include: alkyl groups, such as a methyl group, an ethyl group, a propyl group, and a butyl group; aralkyl groups, such as a benzyl group, a phenethyl group, and a naphthylmethyl group; aromatic ring groups, such as a phenyl group, a naphthyl group, an anthryl group, a pyrenyl group, a fluorenyl group, a carbazolyl group, a dibenzofuryl group, and a dibenzothiophenyl group; alkoxy groups, such as a methoxy group, an ethoxy group, and a propoxy group; aryloxy groups, such as a phenoxy group and a naphthoxy group; halogen atoms, such as fluorine, chlorine, bromine, and iodine; and a nitro group and a cyano group.

Examples of the charge-transportable monomer having a methoxy group, an amino group, a thiol group, or a carboxyl group include compounds obtained by replacing each of the hydroxy groups in the charge-transportable monomers represented by the formulae (1) to (6) with any one of a methoxy group, an amino group, a thiol group, and a carboxyl group. In addition, examples of the charge-transportable monomer include compounds obtained by replacing each of the divalent oxygen atoms $(O)_{a1\ to\ a3}$, $(O)_{b1\ to\ b3}$, $(O)_{c1\ to\ c3}$, and $(O)_{m1}$ (where a1 to a3, b1 to b3, c1 to c3, and m1 each represent 1) in the charge-transportable monomers represented by the formulae (1) to (4) with (S) or (NH).

Exemplary compounds represented by the formula (1-1) to the formula (6-20) are shown below as examples of the charge-transportable monomers represented by the formulae (1) to (6). However, the charge-transportable monomers are not limited to these exemplary compounds, and as in the foregoing, include compounds obtained by replacing each of the hydroxy groups of these exemplary compounds with any one of an amino group, a thiol group, and a carboxyl group, and/or compounds obtained by replacing each of the divalent oxygen atoms thereof with S or NH.

(1-1)

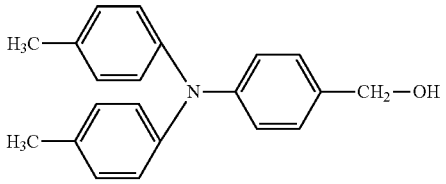

(1-2)

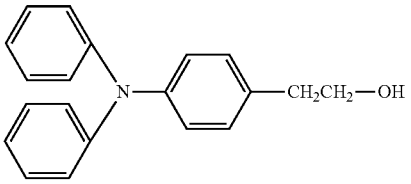

-continued
(1-3)
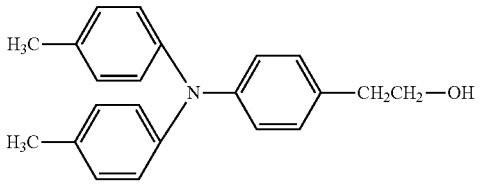
(1-4)
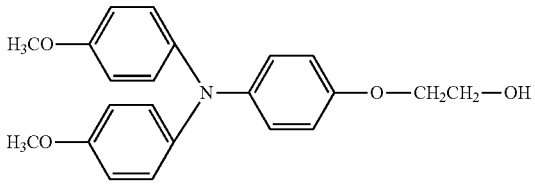
(1-5)
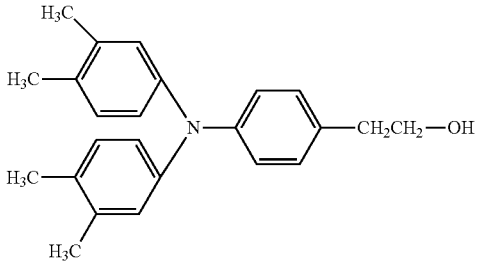
(1-6)
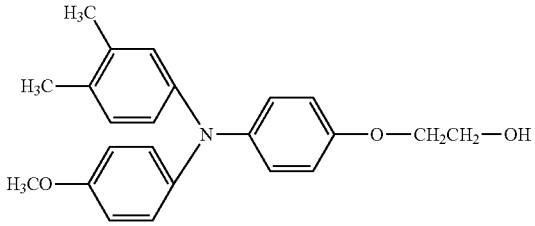
(1-7)
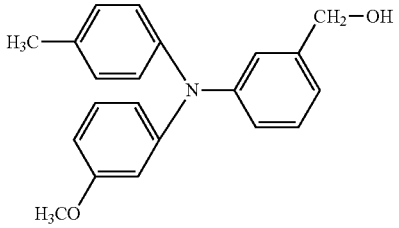
(1-8)
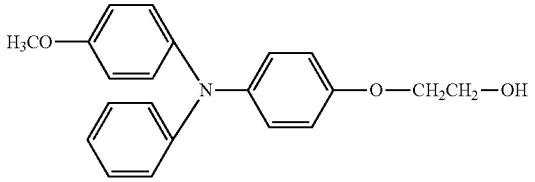
(1-9)
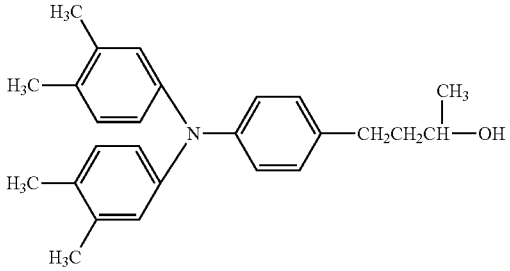
(1-10)
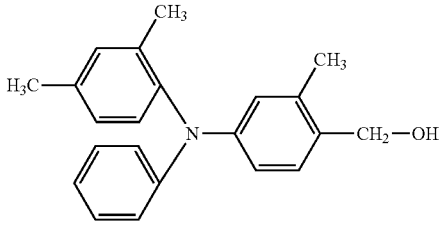
(1-11)
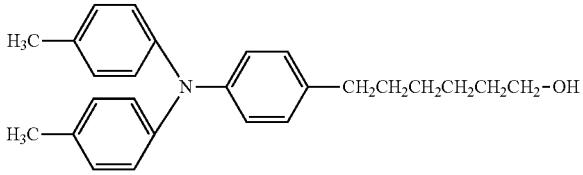
(1-12)
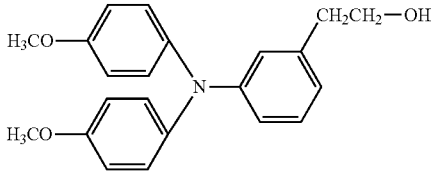
(1-13)
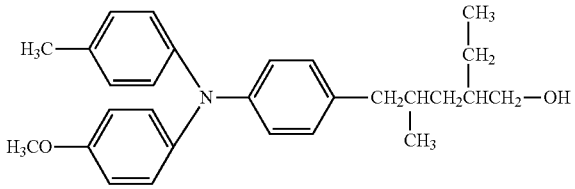
(1-14)
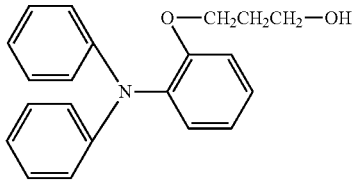

-continued
(1-15)
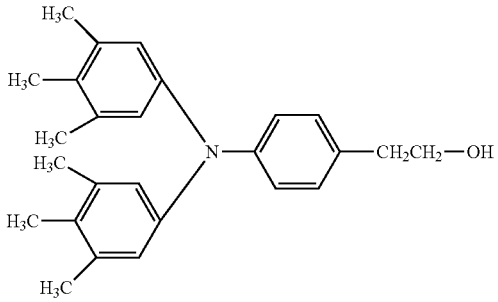
(1-16)
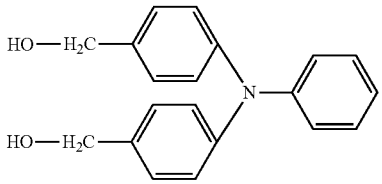
(1-17)
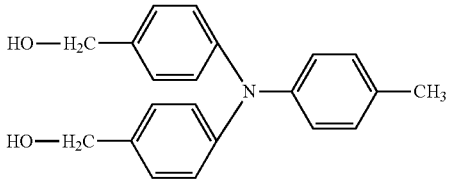
(1-18)
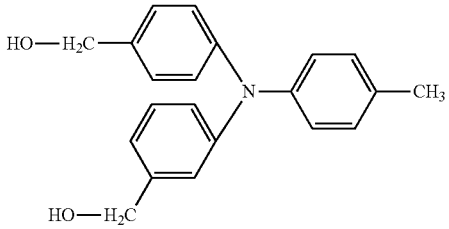
(1-19)
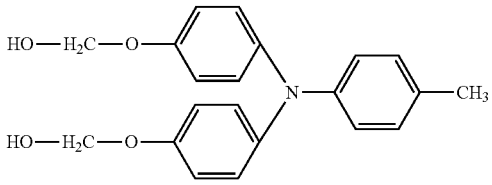
(1-20)
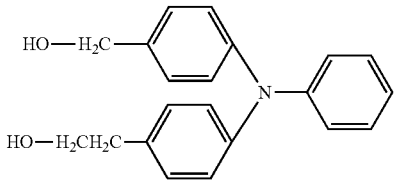
(1-21)
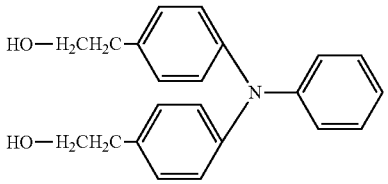
(1-22)
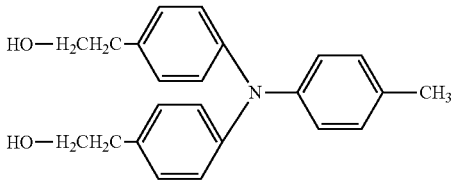
(1-23)
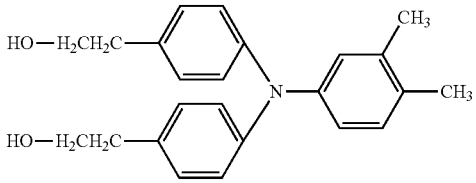
(1-24)
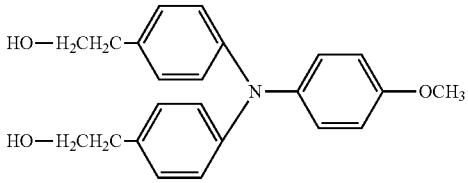
(1-25)
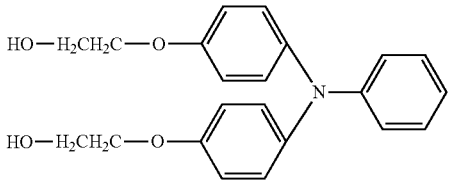
(1-26)
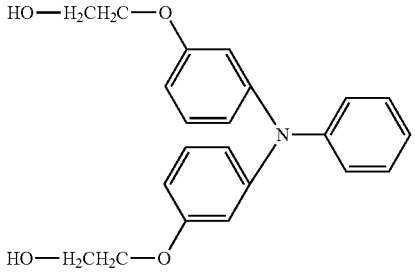
(1-27)
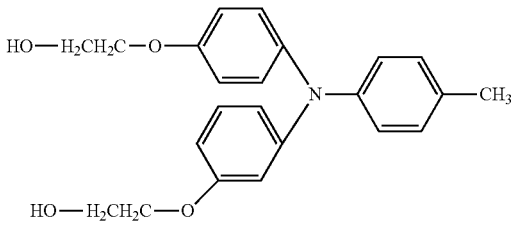
(1-28)
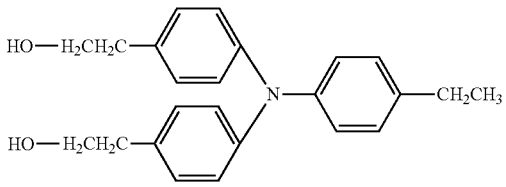

-continued
(1-29)
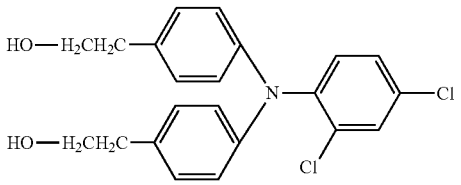
(1-30)
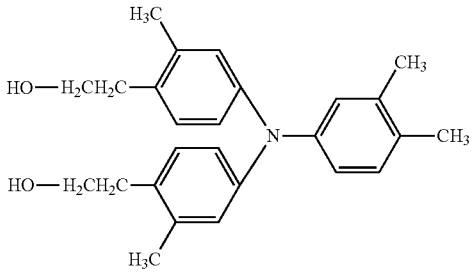
(1-31)
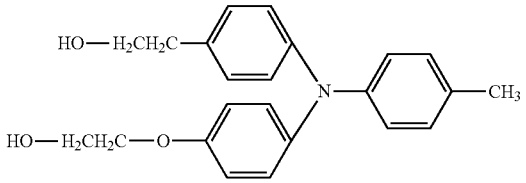
(1-32)
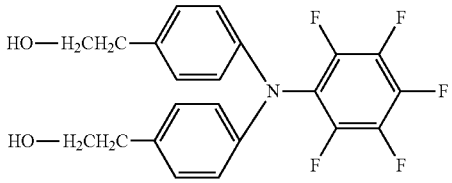
(1-33)
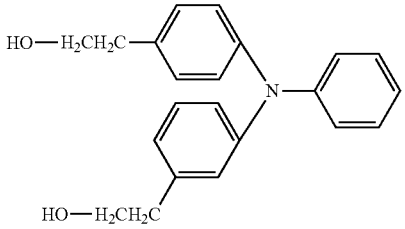
(1-34)
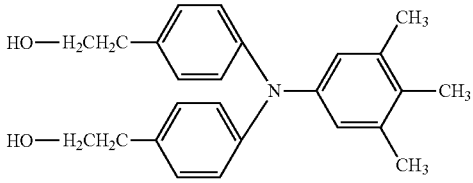
(1-35)
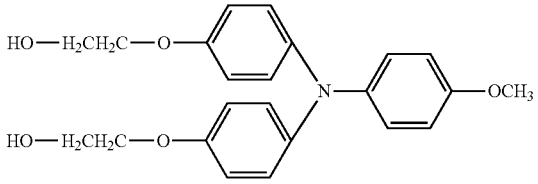
(1-36)
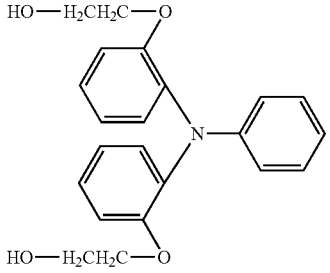
(1-37)
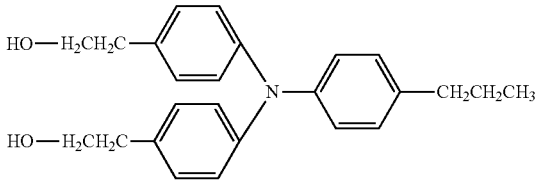
(1-38)
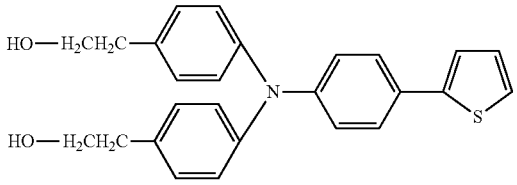
(1-39)
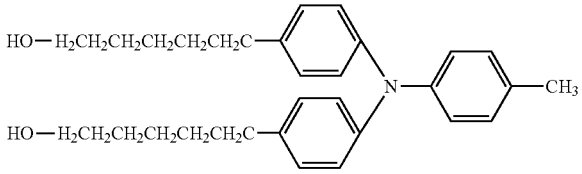
(1-40)
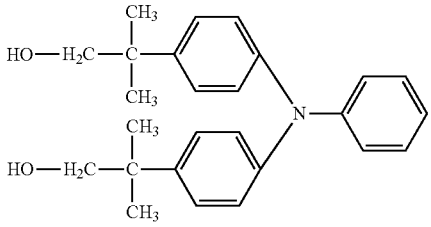

-continued
(1-41)
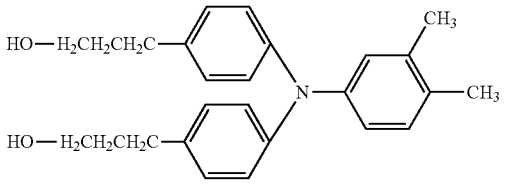
(1-42)
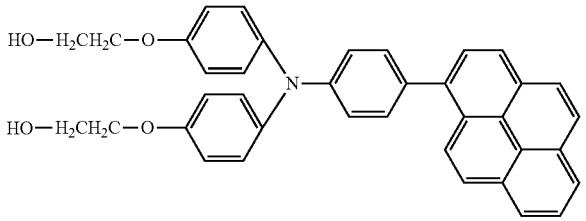
(1-43)
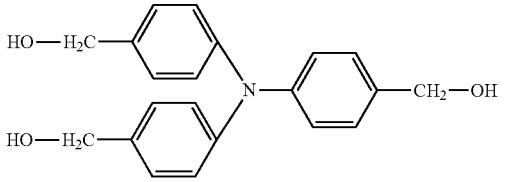
(1-44)
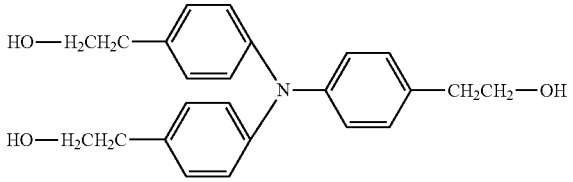
(1-45)
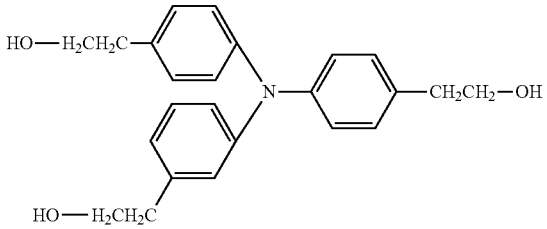
(1-46)
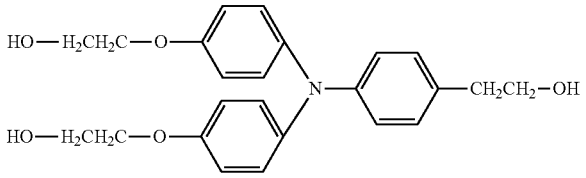
(1-47)
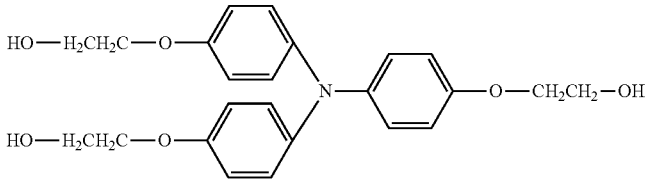
(1-48)
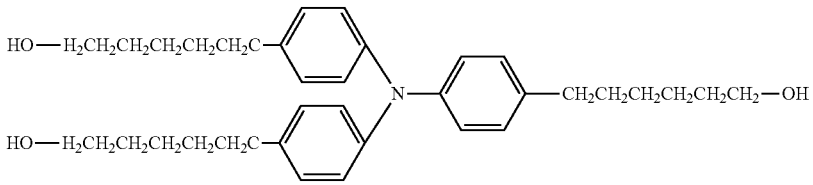
(1-49)
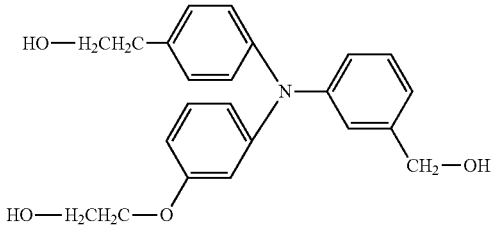
(1-50)
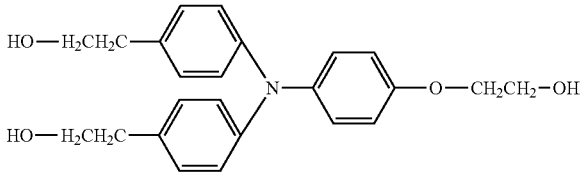

-continued
(1-51)
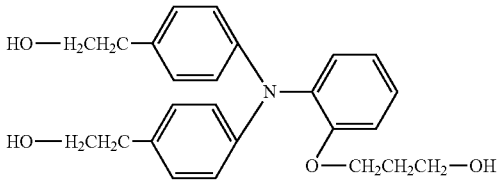
(1-52)
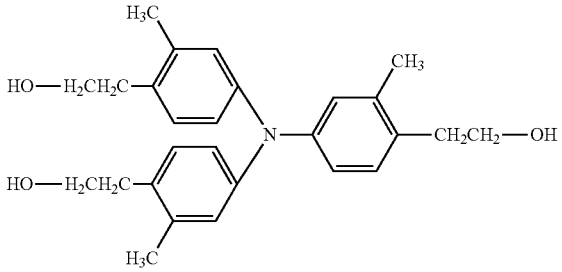
(1-53)
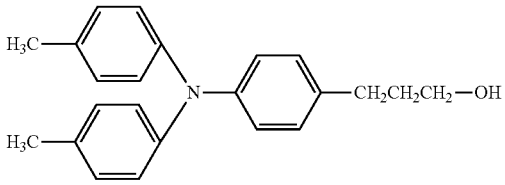
(1-54)
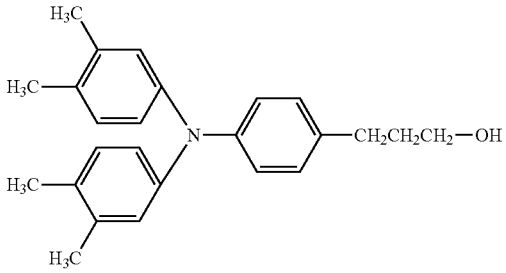
(1-55)
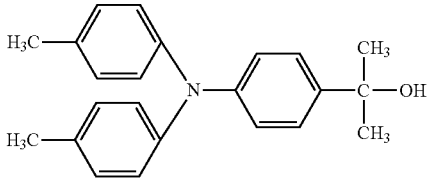
(1-56)
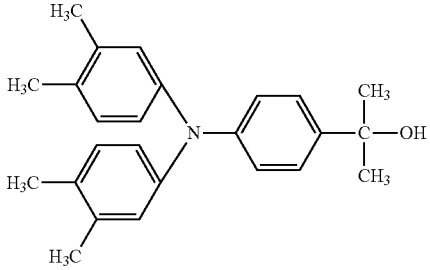
(1-57)
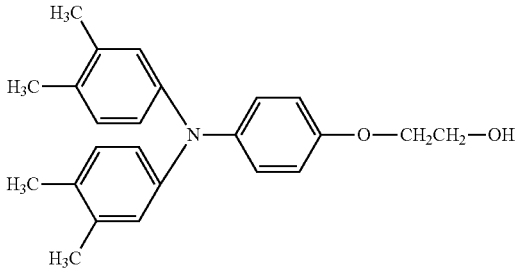
(1-58)
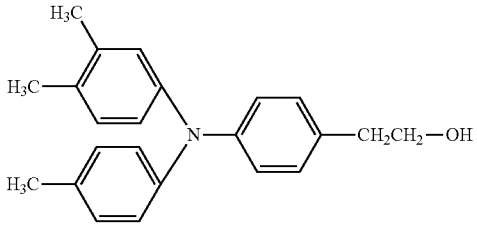
(1-59)
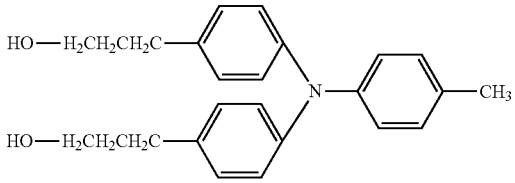
(1-60)
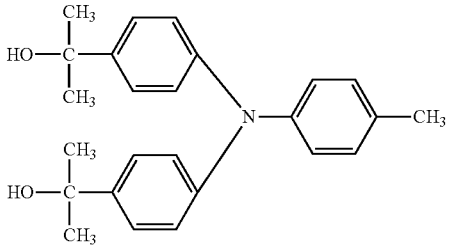

-continued
(1-61)
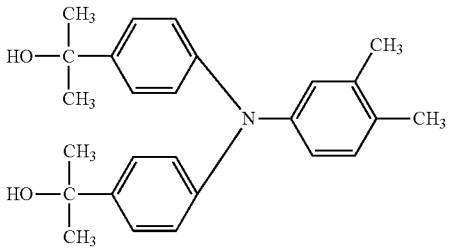
(1-62)
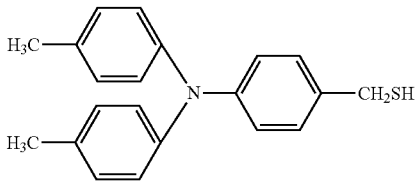
(1-63)
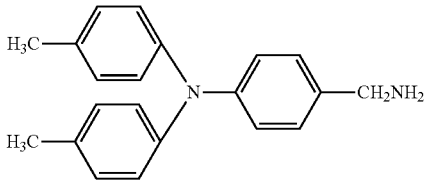
(1-64)
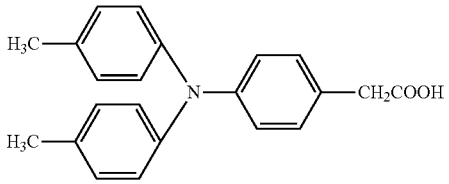
(1-65)
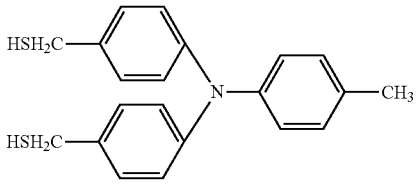
(1-66)
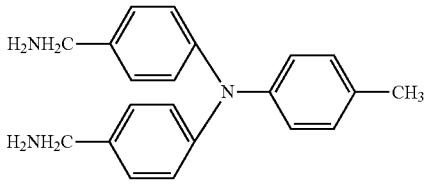
(2-1)
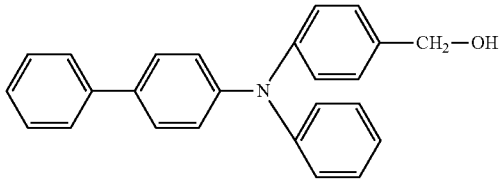
(2-2)
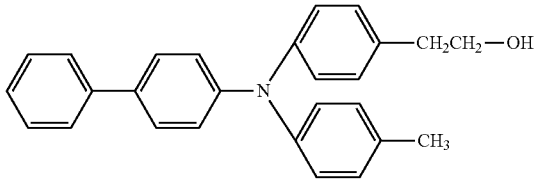
(2-3)
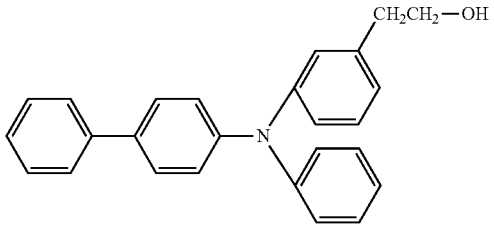
(2-4)
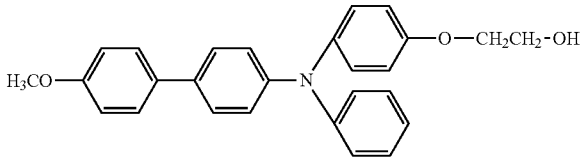
(2-5)
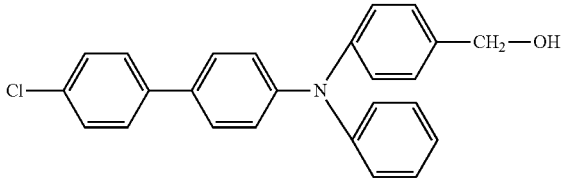
(2-6)
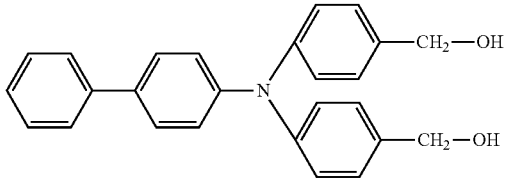
(2-7)
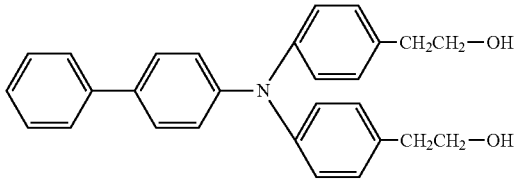
(2-8)
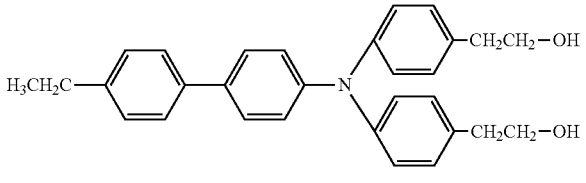

-continued
(2-9)
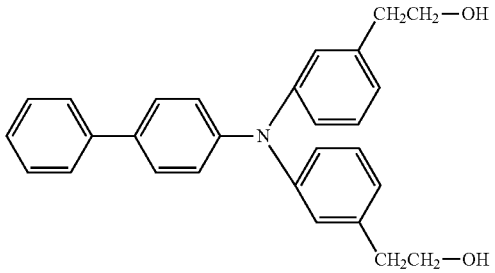
(2-10)
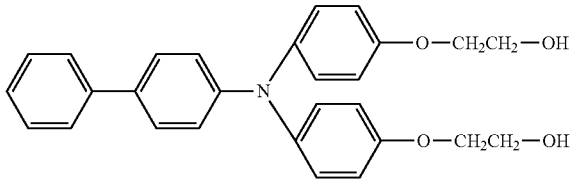
(2-11)
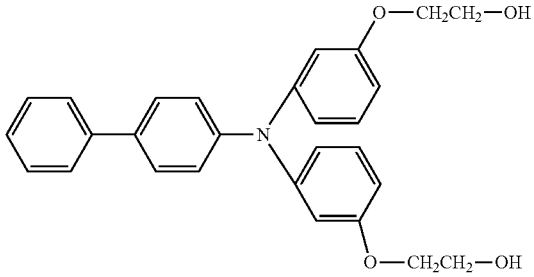
(2-12)
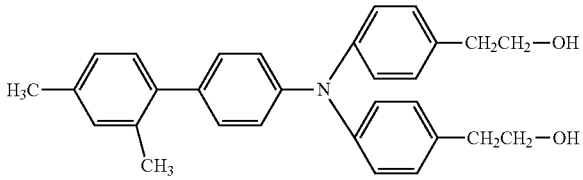
(2-13)
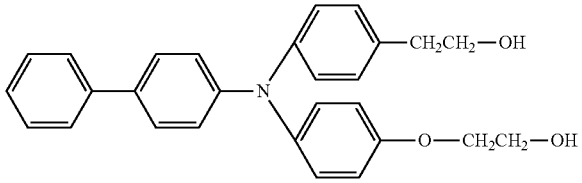
(2-14)
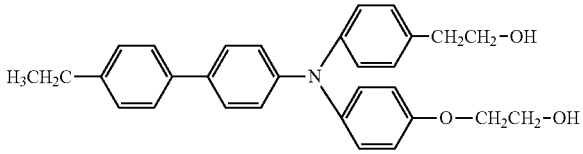
(2-15)
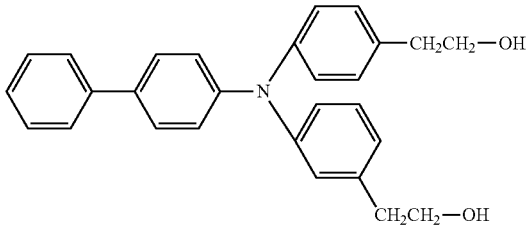
(2-16)
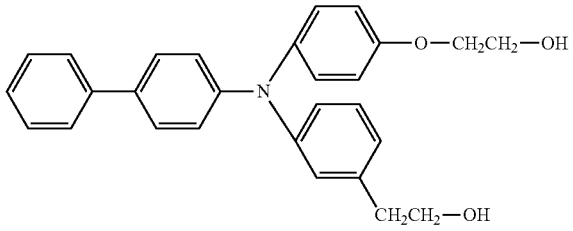
(2-17)
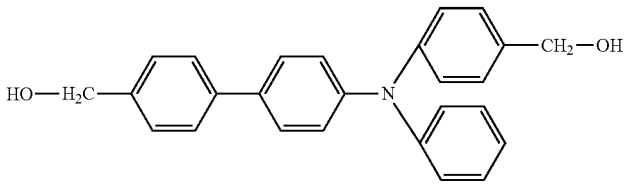
(2-18)
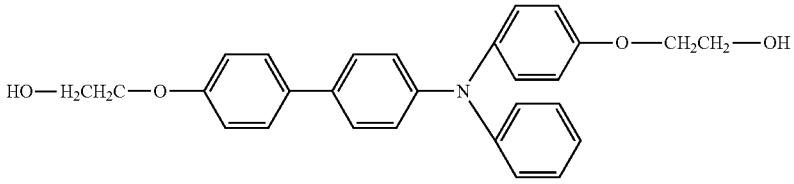

-continued
(2-19)
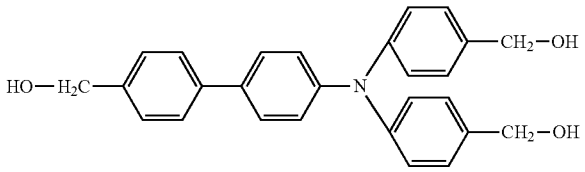
(2-20)
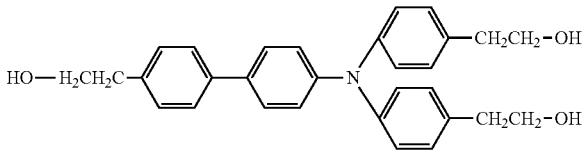
(2-21)
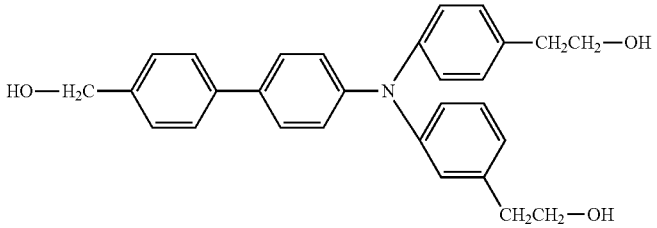
(2-22)
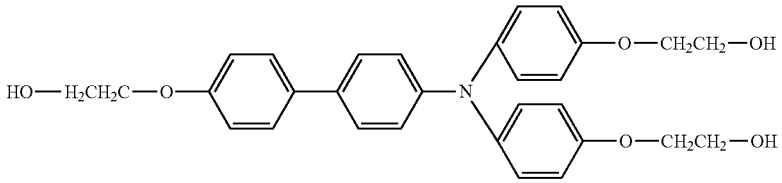
(2-23)
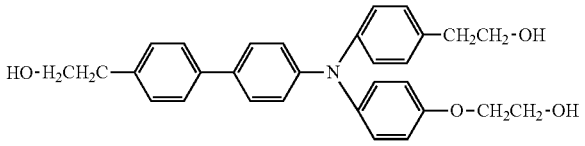
(2-24)
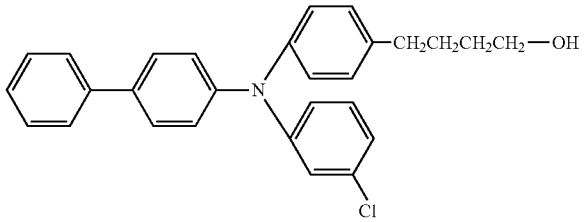
(2-25)
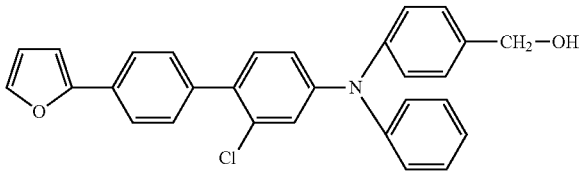
(2-26)
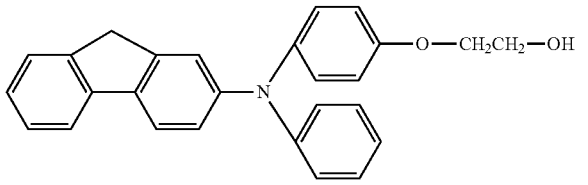
(2-27)
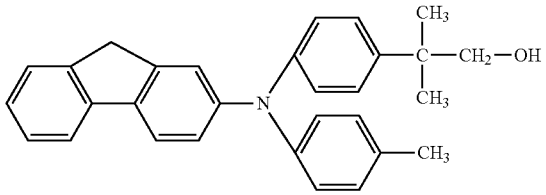
(2-28)
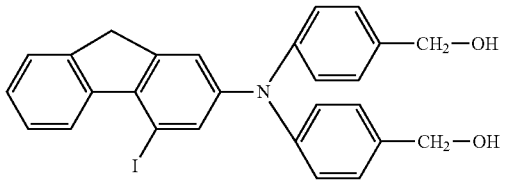
(2-29)
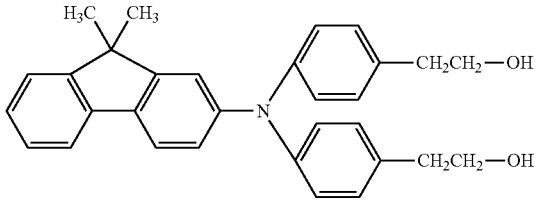
(2-30)
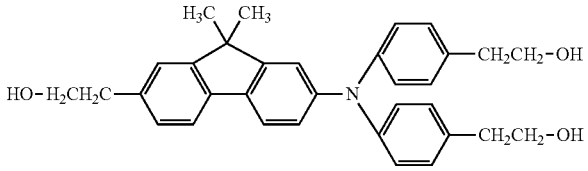

-continued
(2-31)
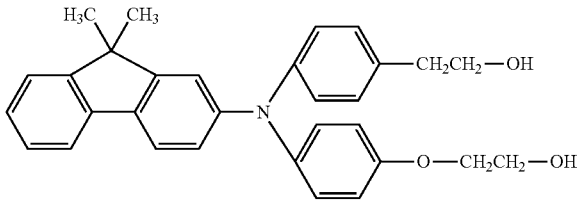
(2-32)
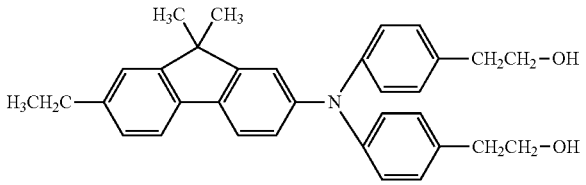
(2-33)
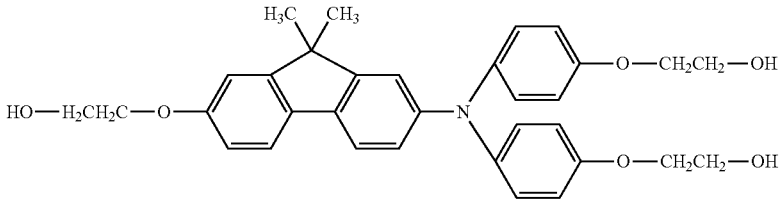
(2-34)
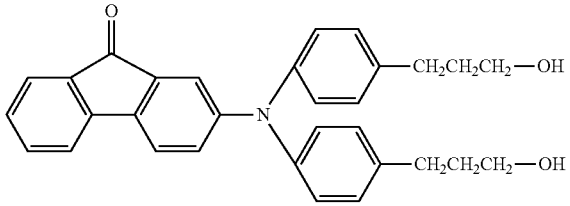
(2-35)
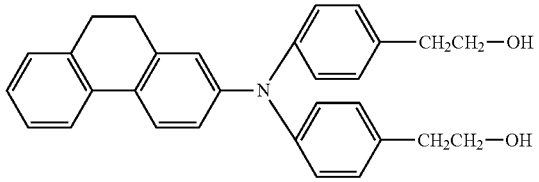
(2-36)
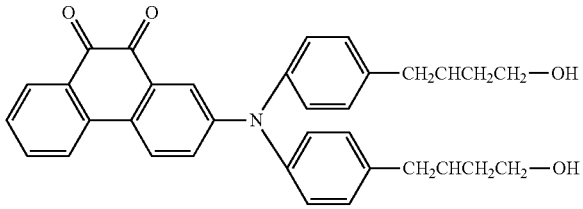
(2-37)
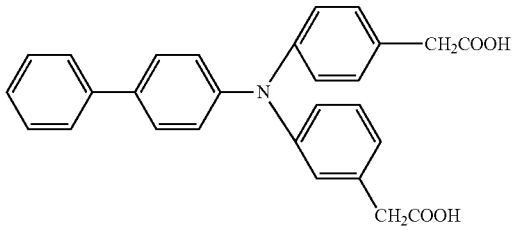
(3-1)
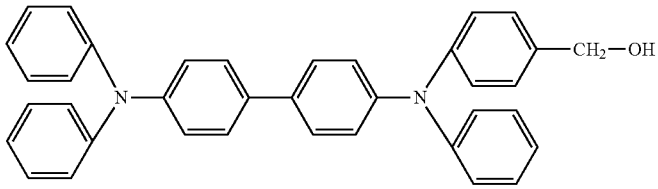
(3-2)
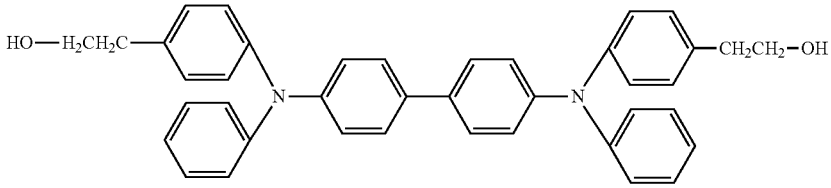
(3-3)
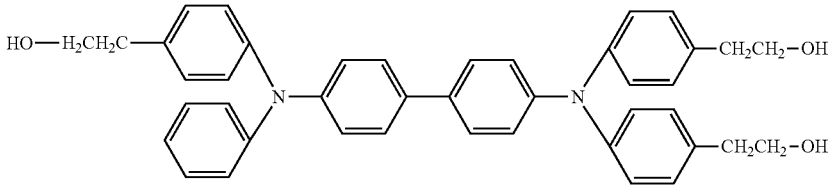

-continued
(3-4)
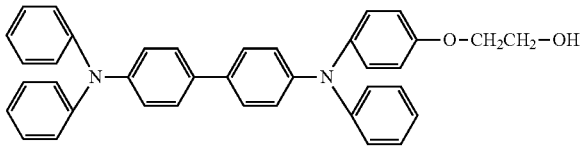
(3-5)
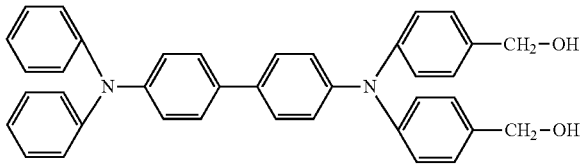
(3-6)
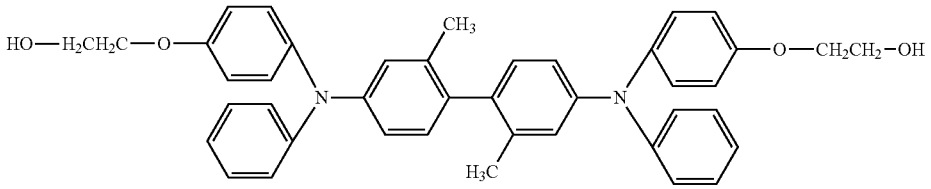
(3-7)
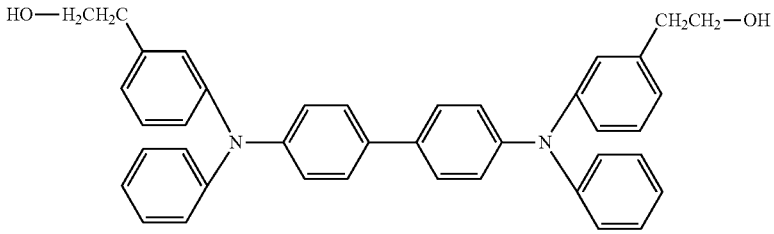
(3-8)
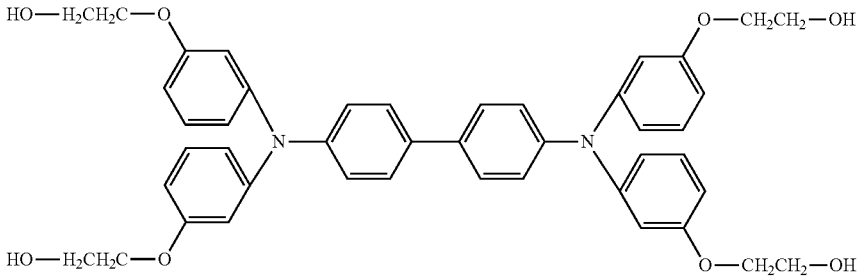
(3-9)
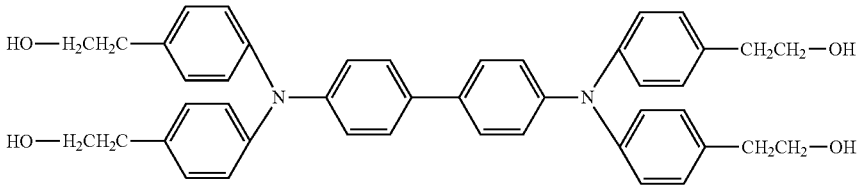
(3-10)
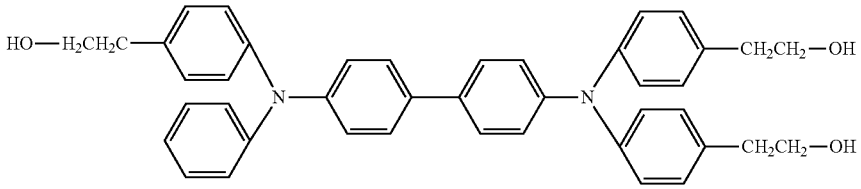
(3-11)
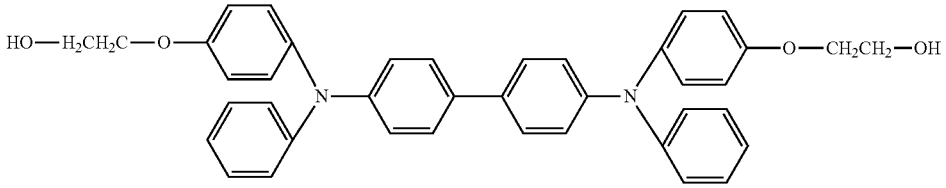

-continued
(3-12)
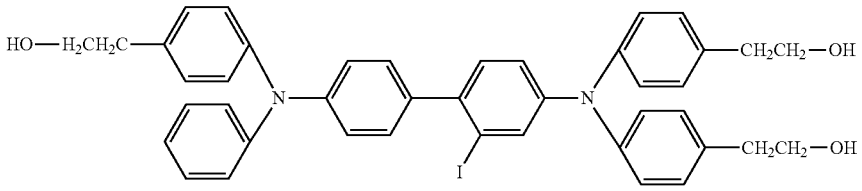
(3-13)
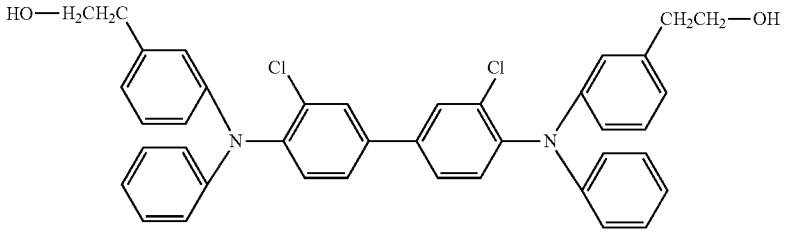
(3-14)
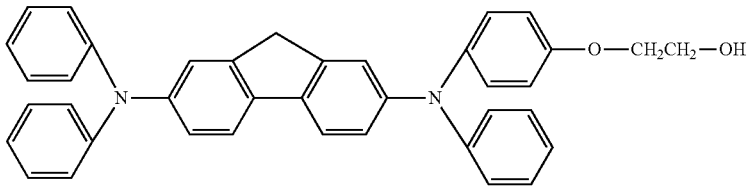
(3-15)
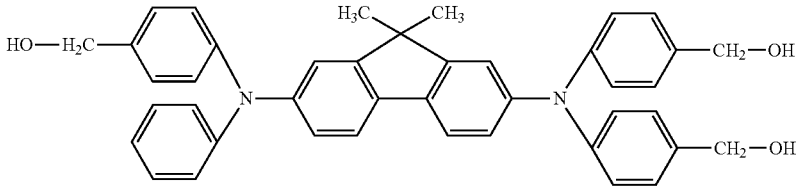
(3-16)
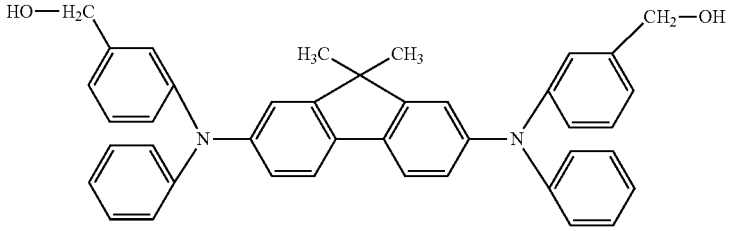
(3-17)
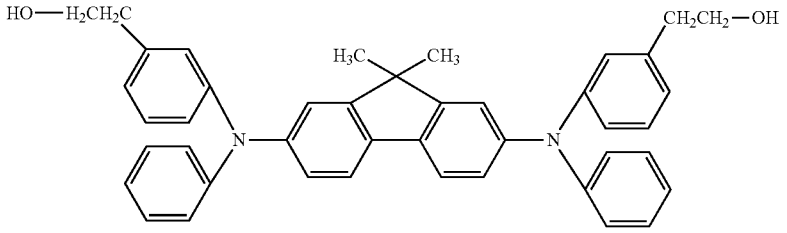
(3-18)
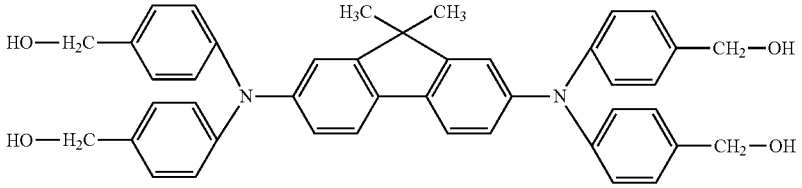

-continued
(3-19)
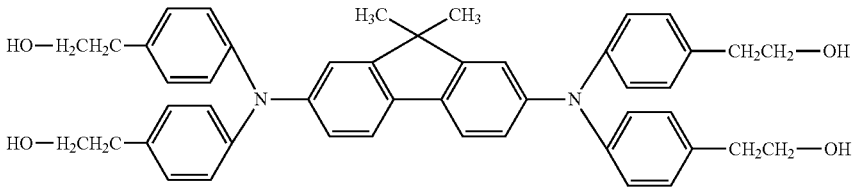
(3-20)
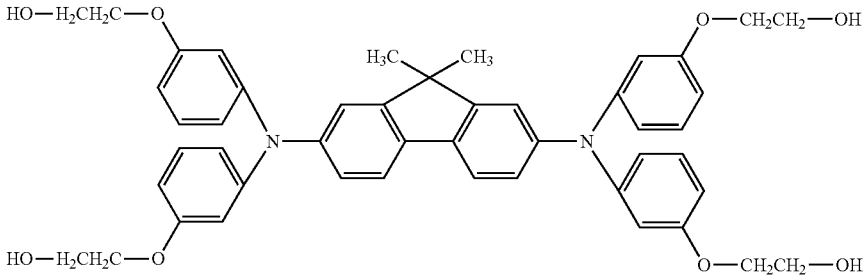
(3-21)
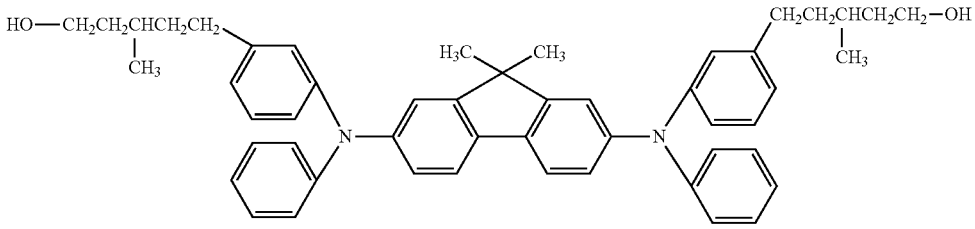
(3-22)
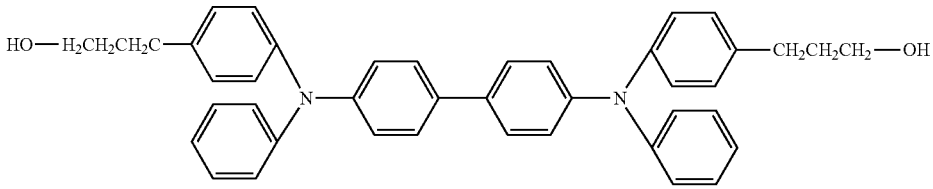
(3-23)
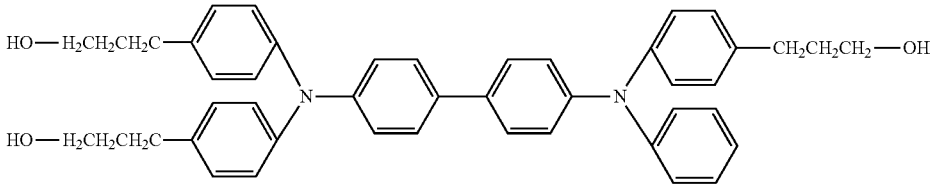
(3-24)
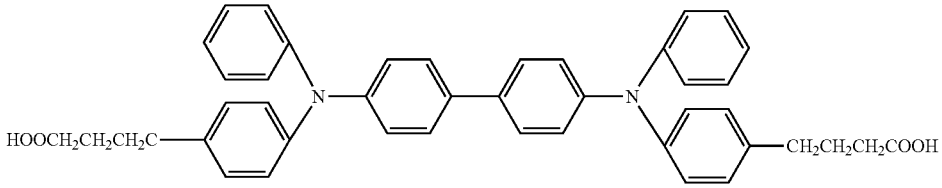

-continued
(4-1)
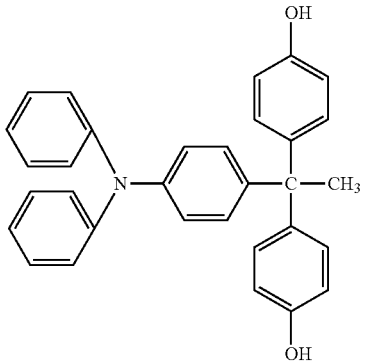
(4-2)
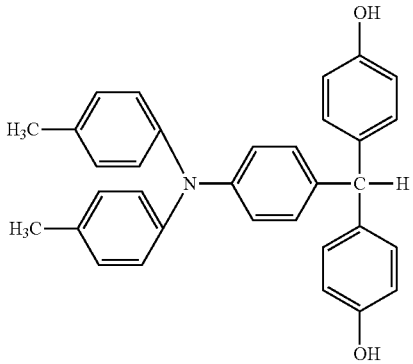
(4-3)
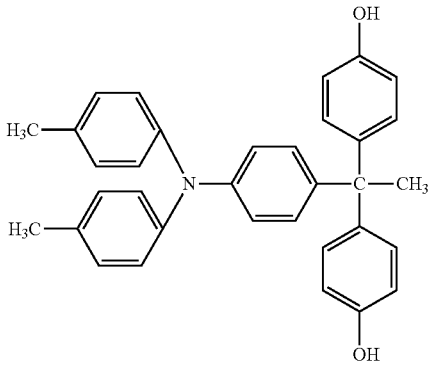
(4-4)
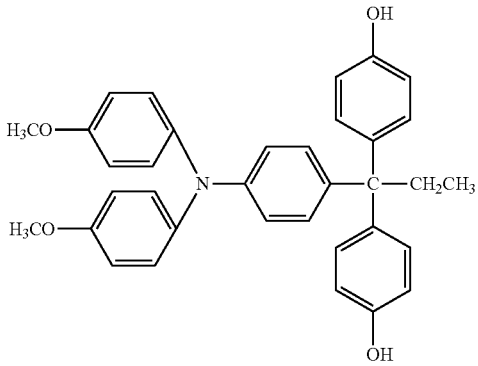
(4-5)
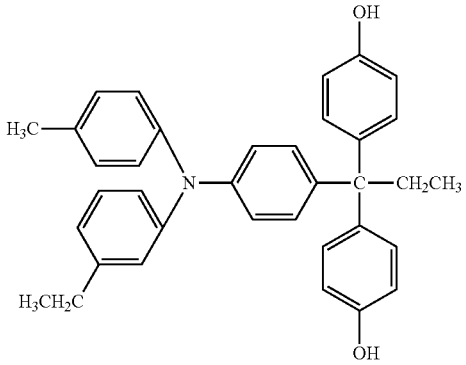
(4-6)
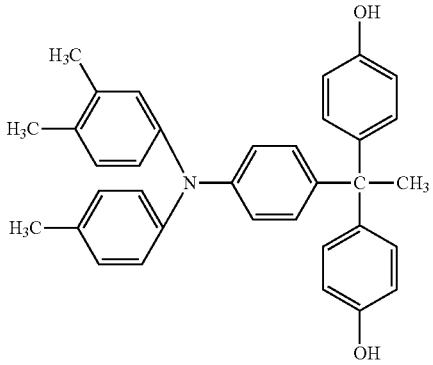
(4-7)
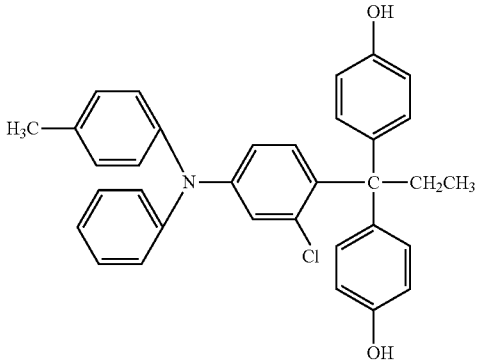
(4-8)
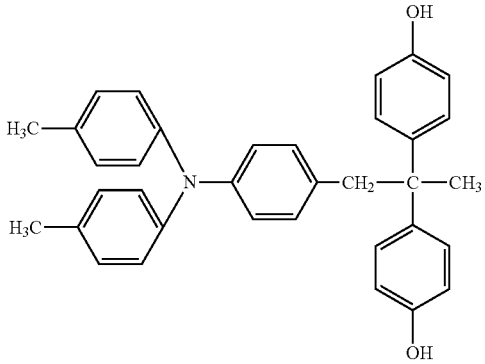

-continued
(4-9)
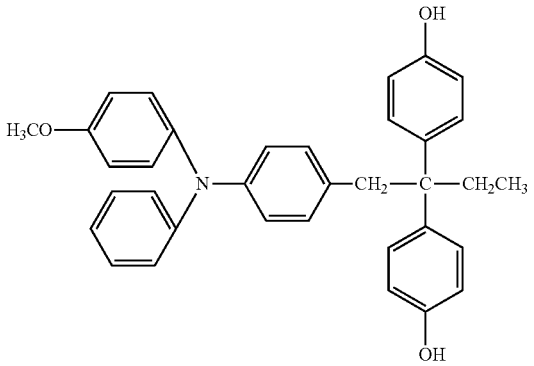
(4-10)
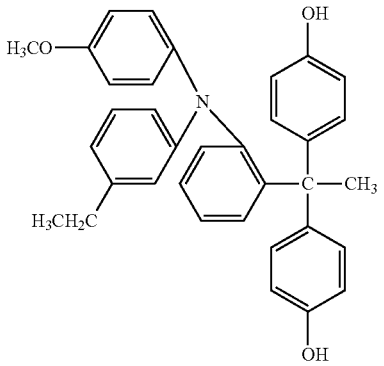
(4-11)
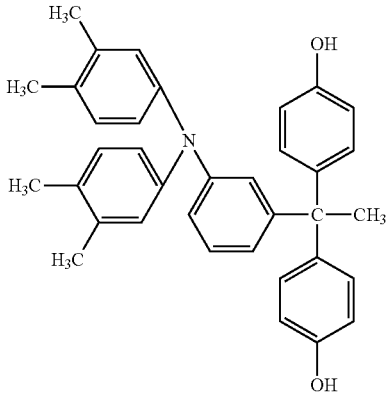
(4-12)
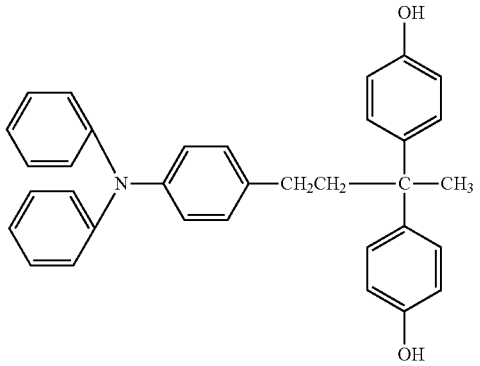
(4-13)
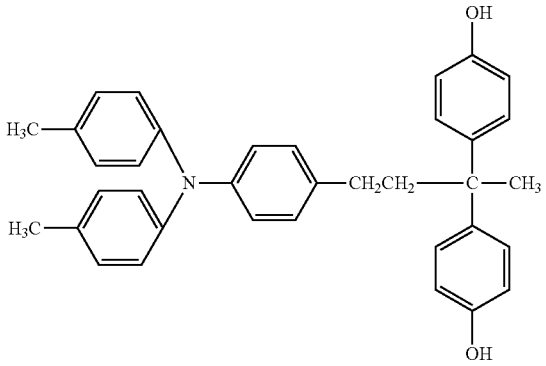
(4-14)
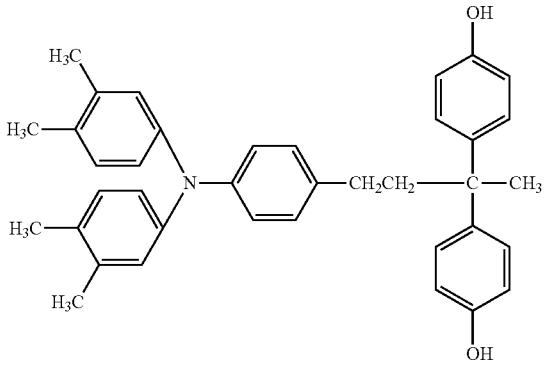
(4-15)
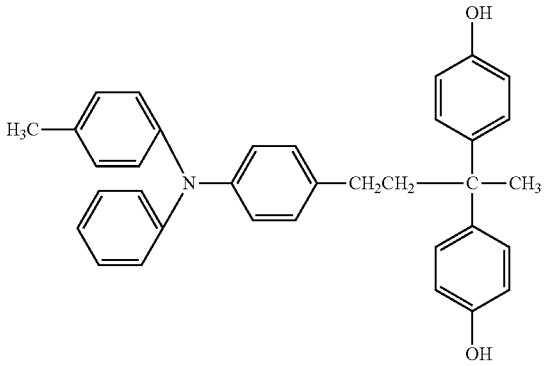
(4-16)
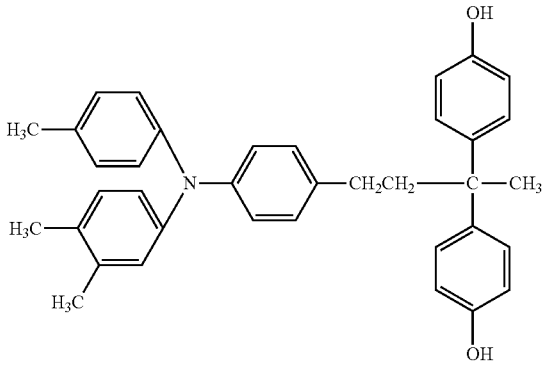

-continued
(4-17)
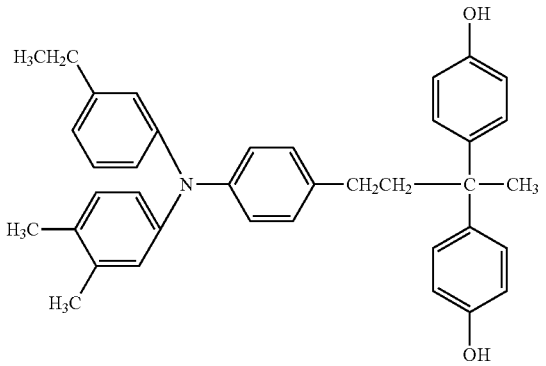
(4-18)
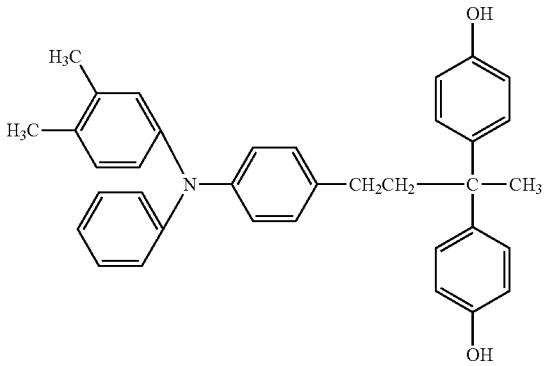
(4-19)
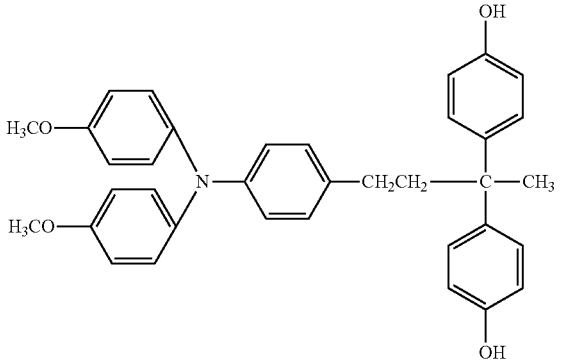
(4-20)
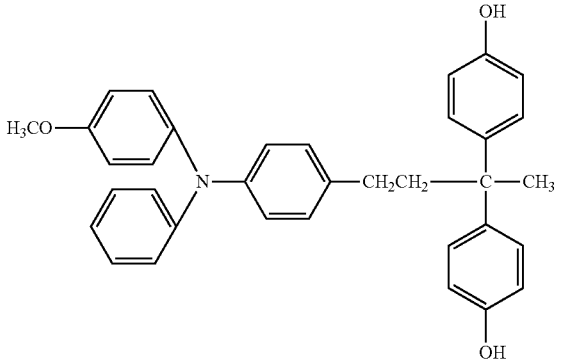
(4-21)
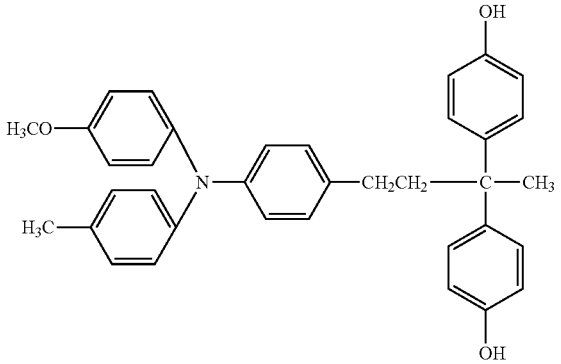
(4-22)
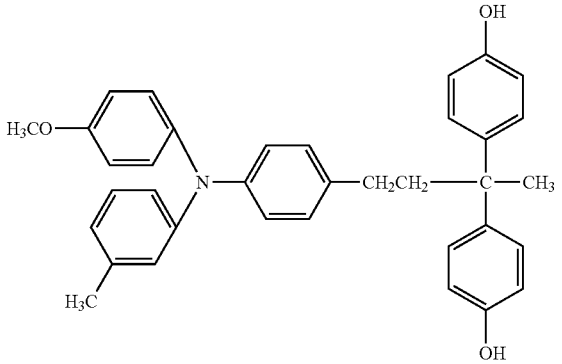
(4-23)
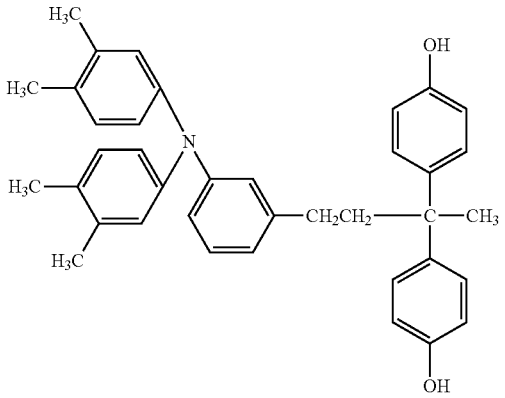
(4-24)
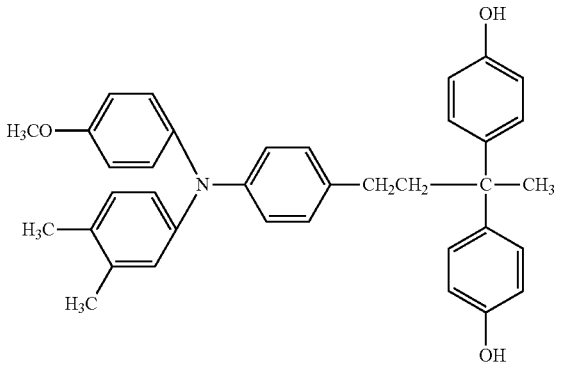

-continued
(4-25)
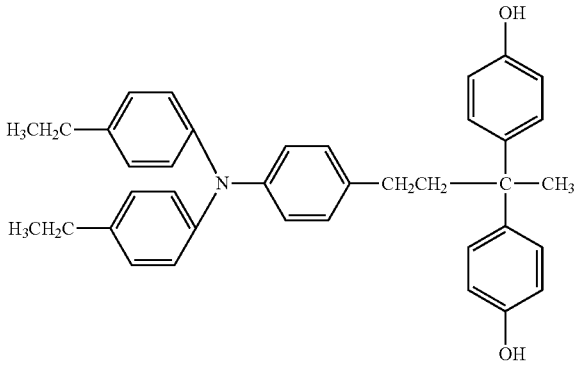
(4-26)
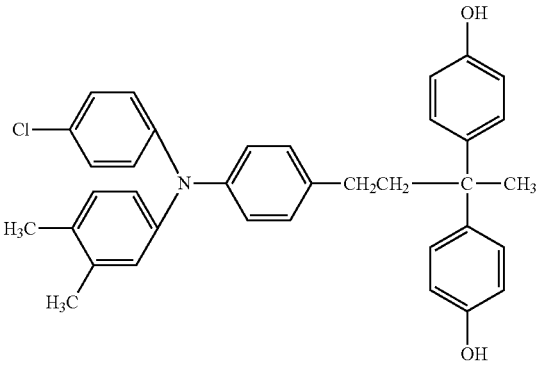
(4-27)
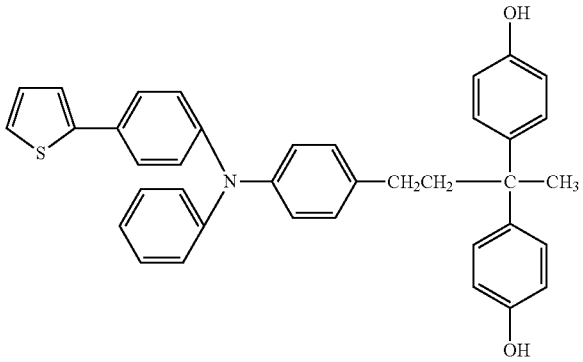
(4-28)
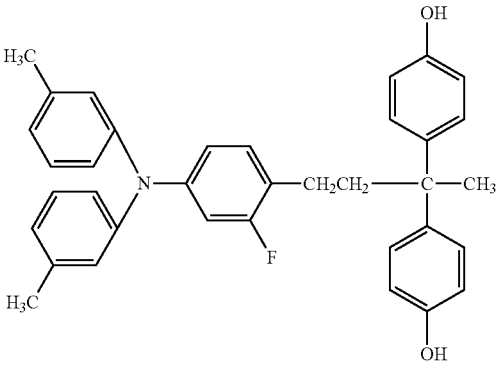
(4-29)
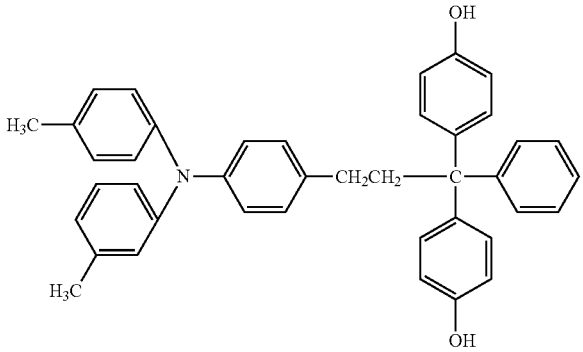
(4-30)
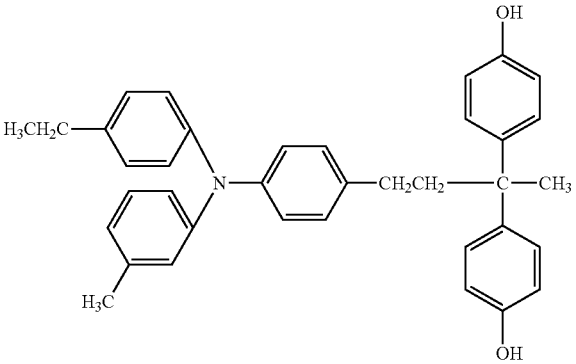
lp;1p
(4-31)
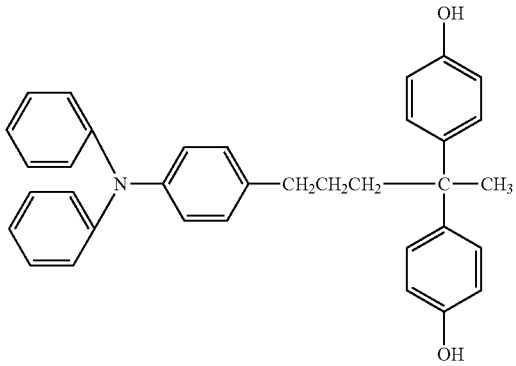
(4-32)
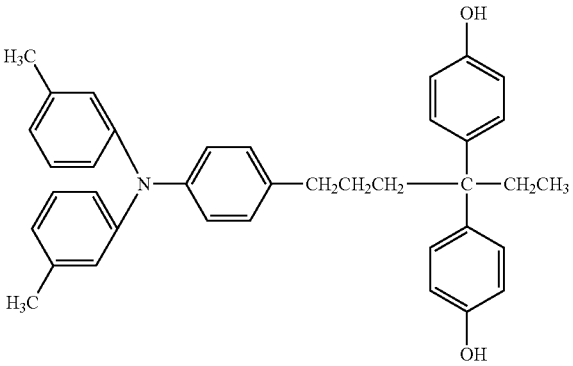

-continued
(4-33)
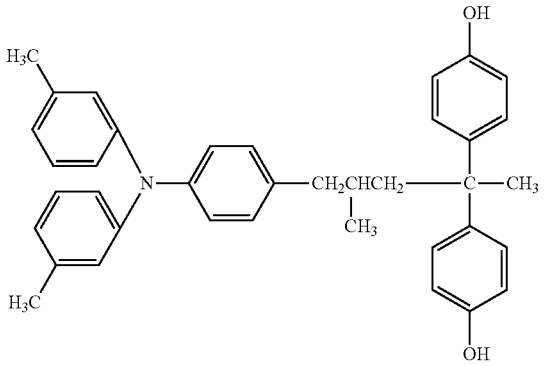
(4-34)
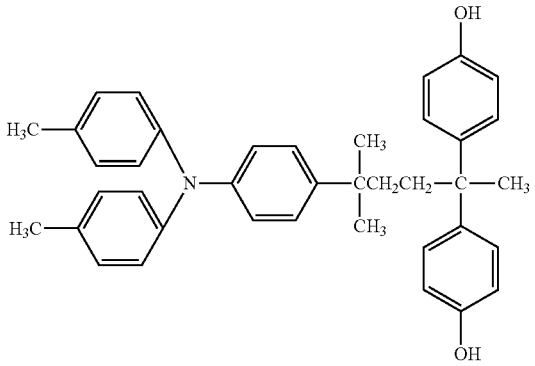
(4-35)
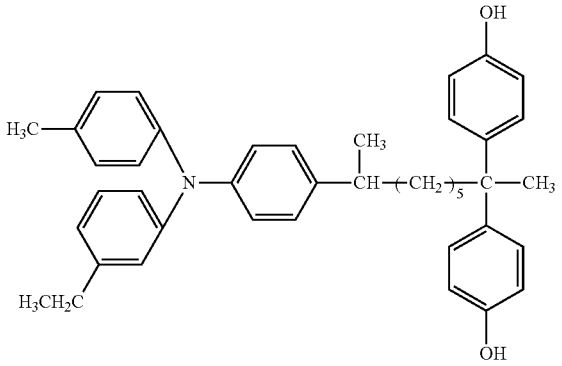
(4-36)
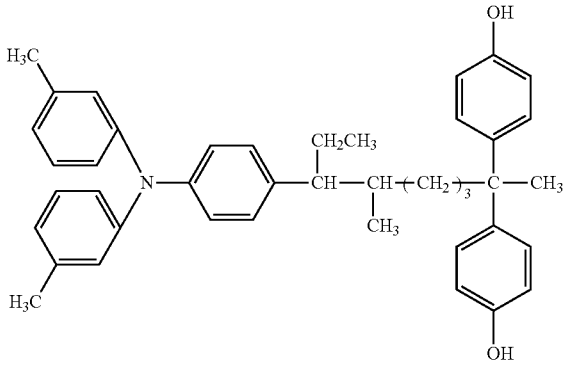
(4-37)
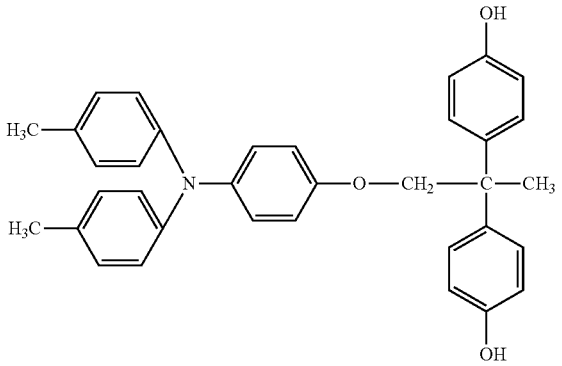
(4-38)
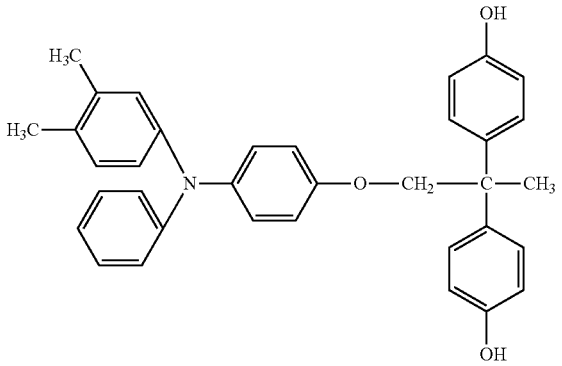
(4-39)
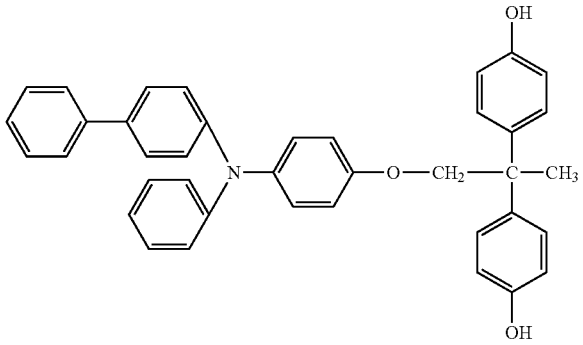
(4-40)
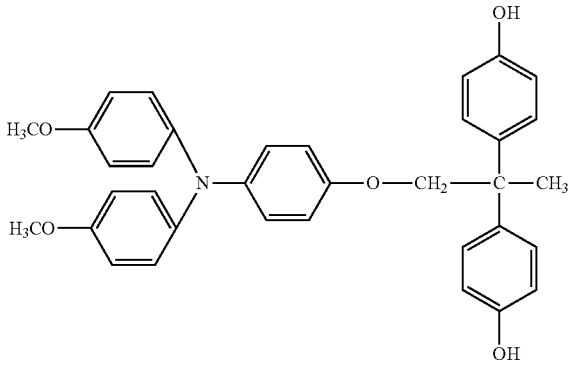

-continued
(4-41)
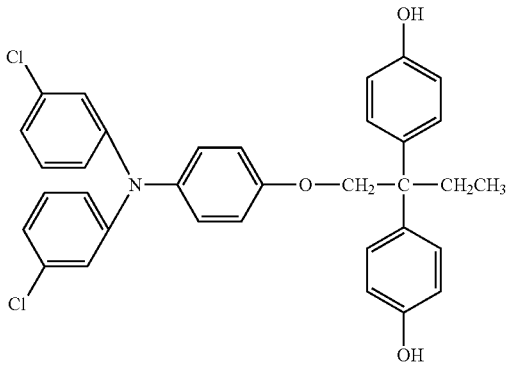
(4-42)
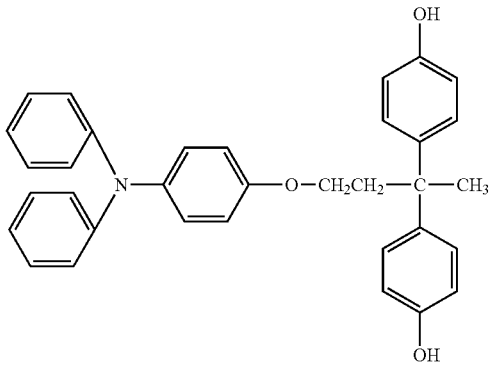
(4-43)
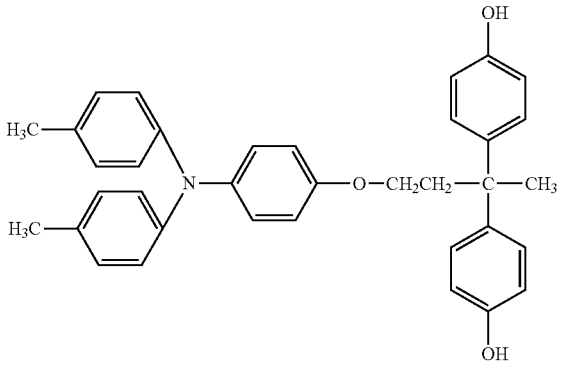
(4-44)
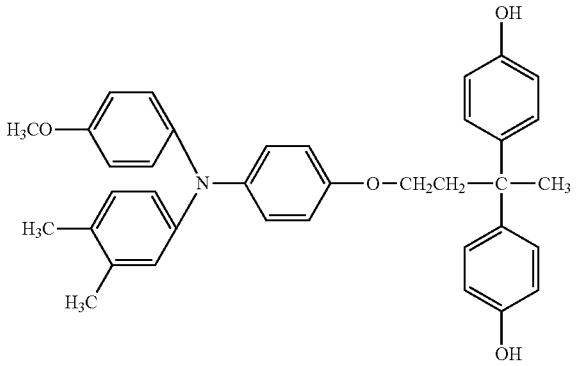
(4-45)
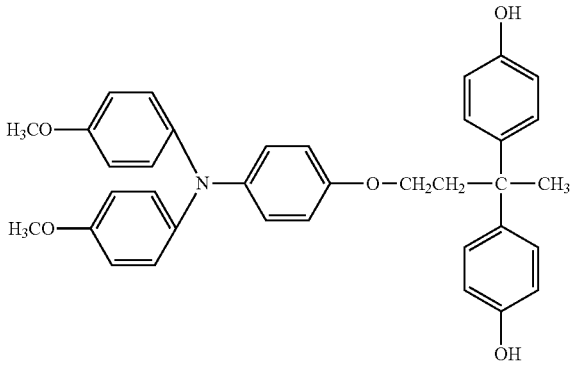
(4-46)
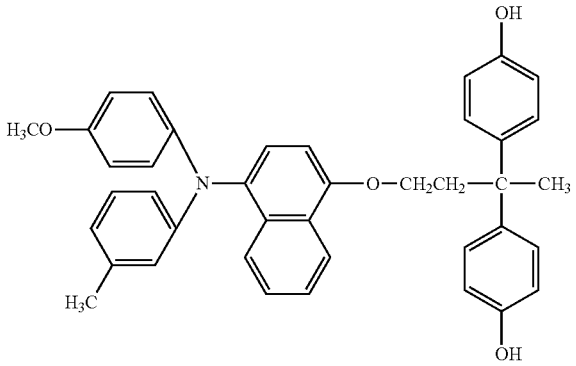
(4-47)
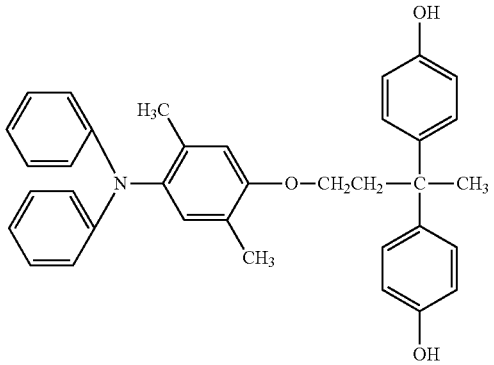
(4-48)
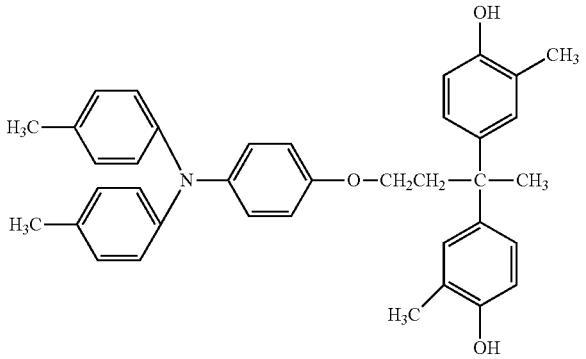

-continued
(4-49)
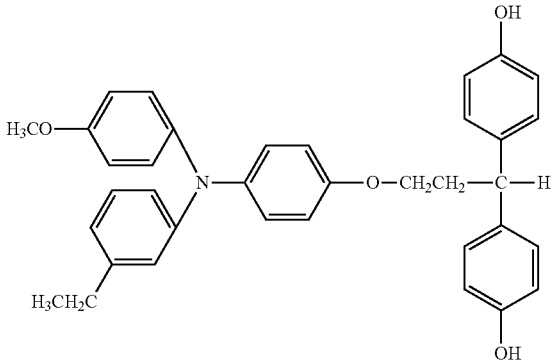
(4-50)
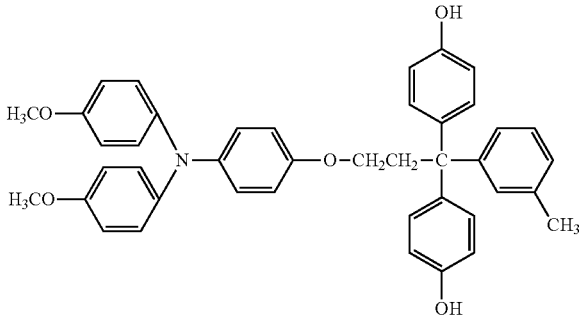
(4-51)
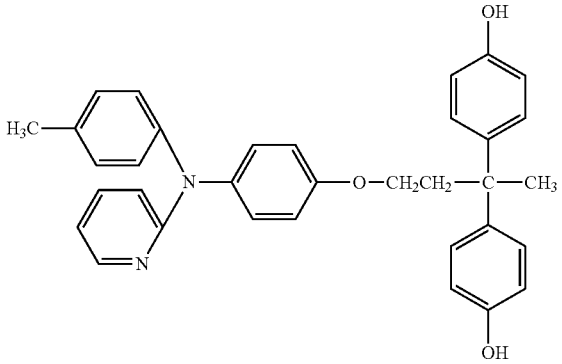
(4-52)
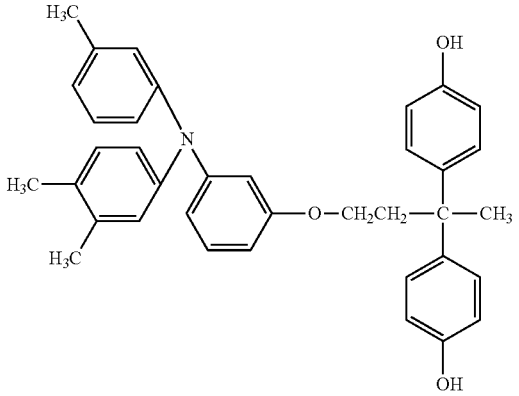
(4-53)
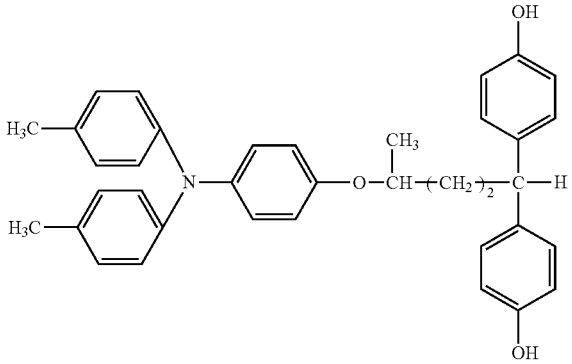
(4-54)
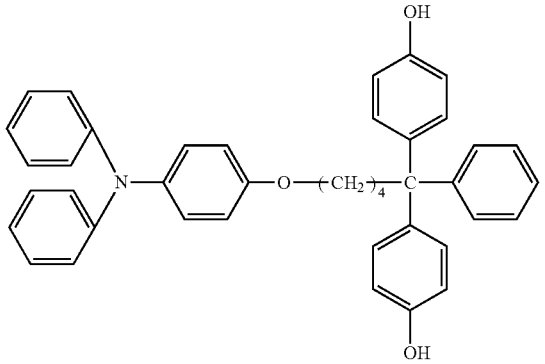
(4-55)
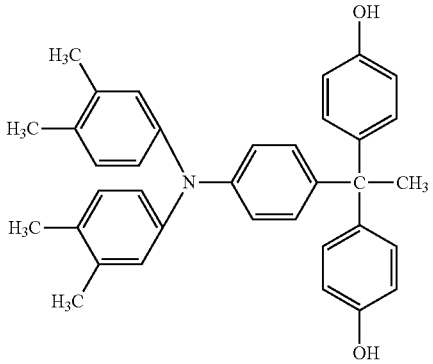
(5-1)
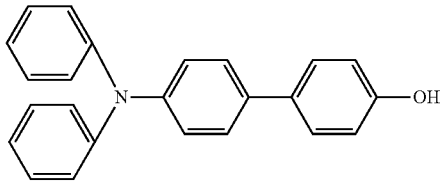

-continued
(5-2)
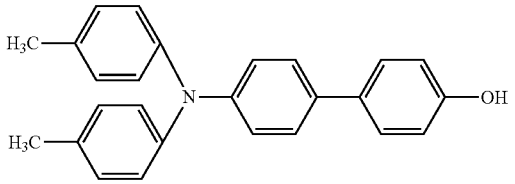
(5-3)
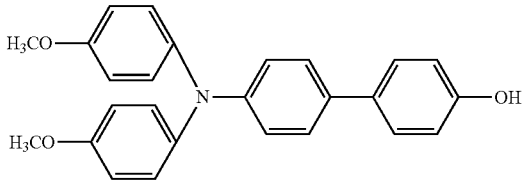
(5-4)
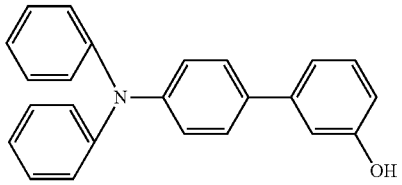
(5-5)
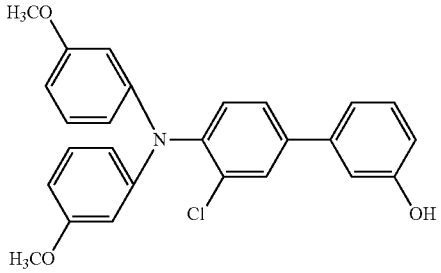
(5-6)
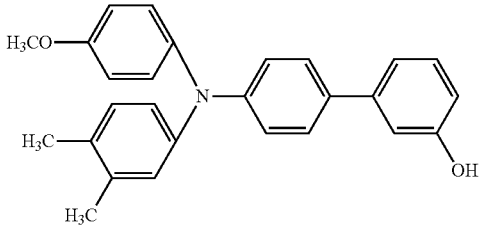
(5-7)
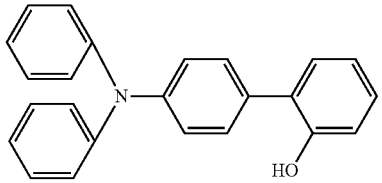
(5-8)
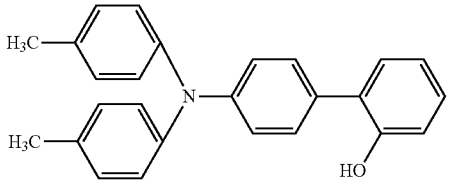
(5-9)
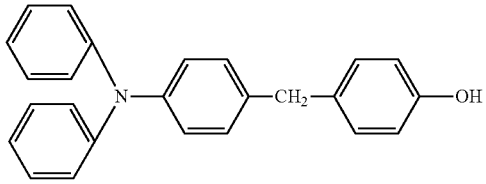
(5-10)
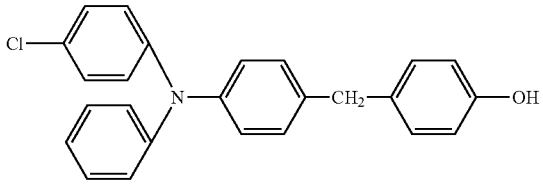
(5-11)
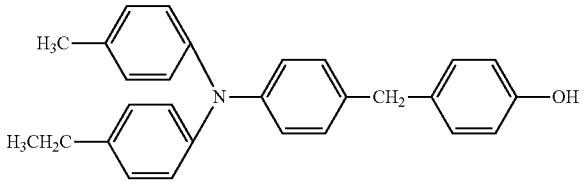
(5-12)
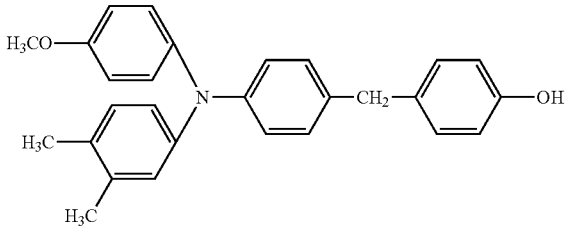
(5-13)
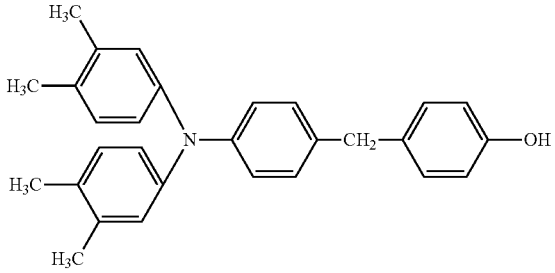
(5-14)
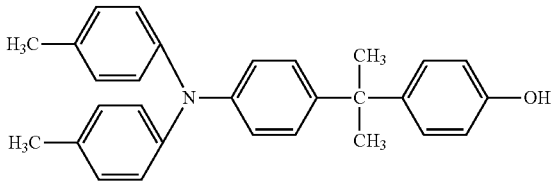
(5-15)
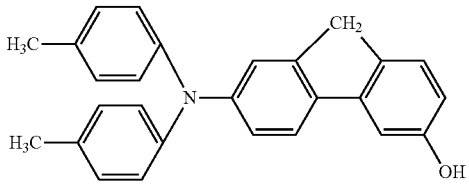

-continued
(5-16)
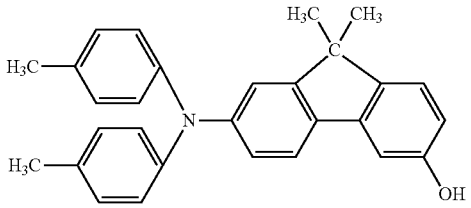
(5-17)
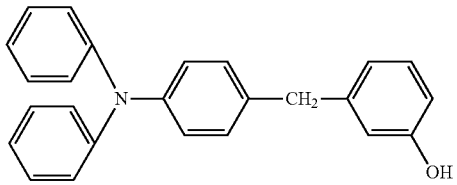
(5-18)
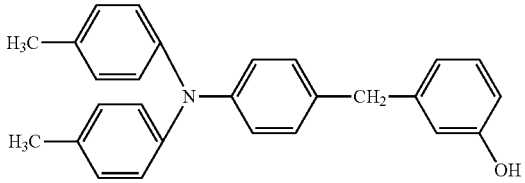
(5-19)
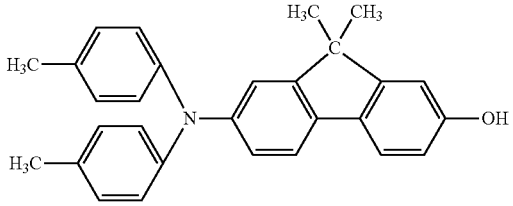
(5-20)
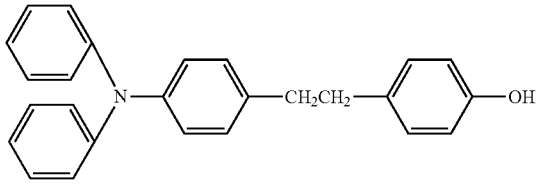
(5-21)
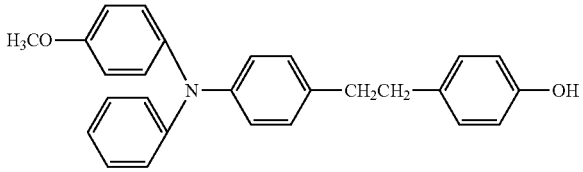
(5-22)
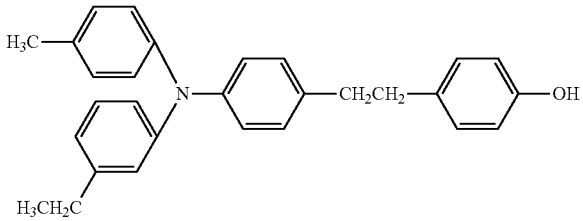
(5-23)
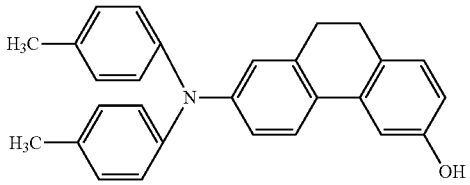
(5-24)
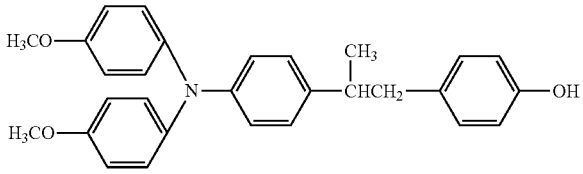
(5-25)
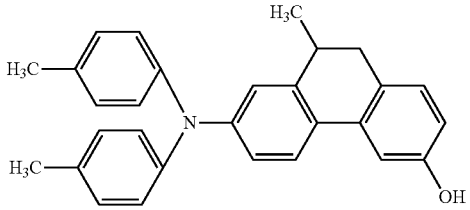
(5-26)
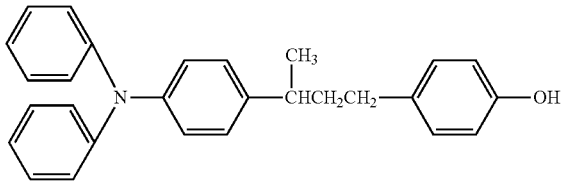
(5-27)
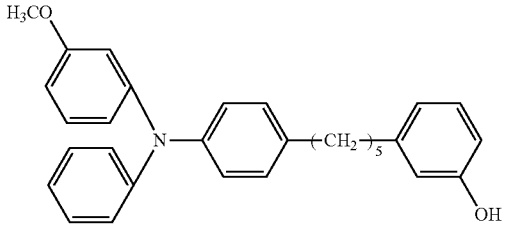

-continued
(5-28)
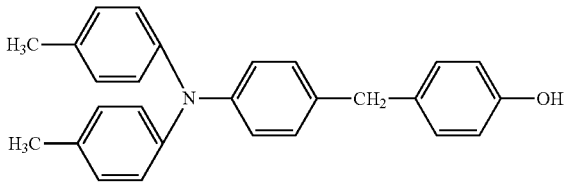
(5-29)
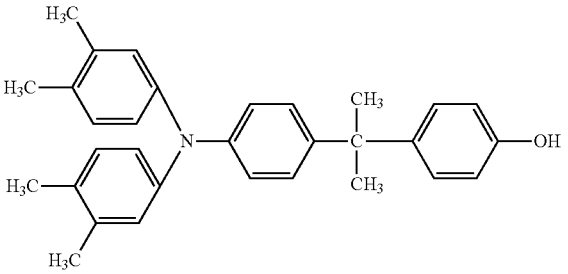
(6-1)
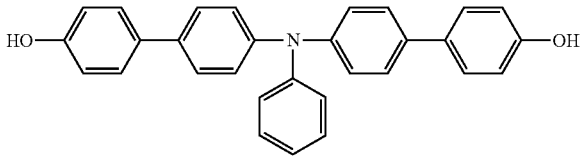
(6-2)
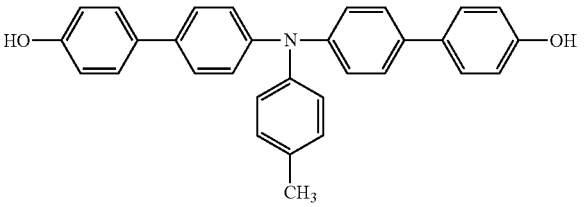
(6-3)
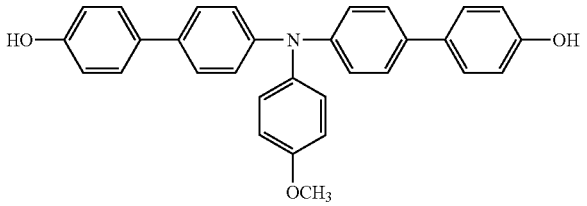
(6-4)
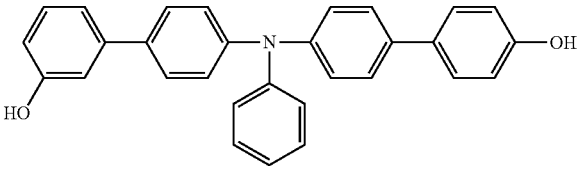
(6-5)
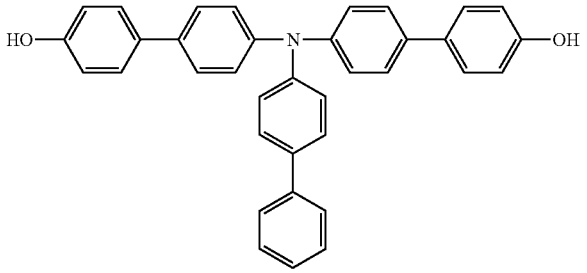
(6-6)
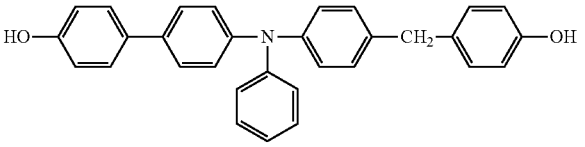
(6-7)
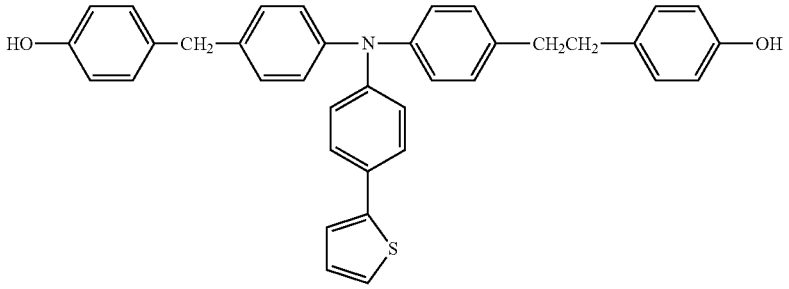
(6-8)
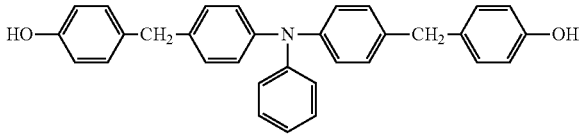
(6-9)
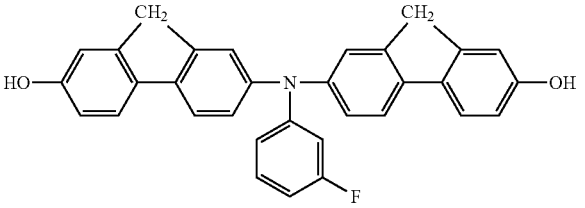

-continued
(6-10)
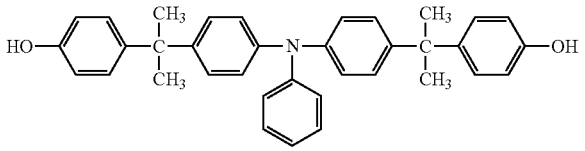
(6-11)
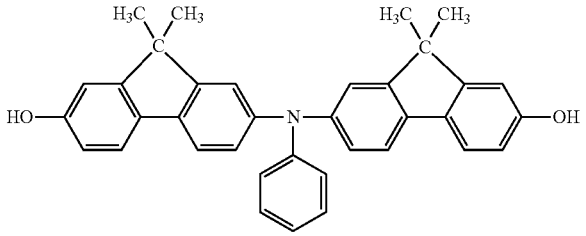
(6-12)
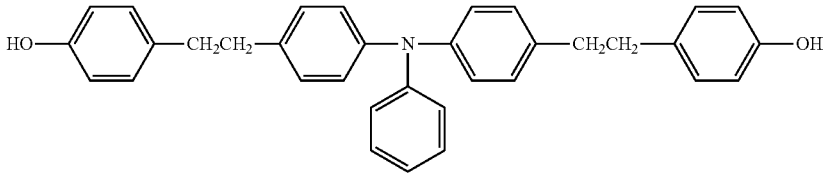
(6-13)
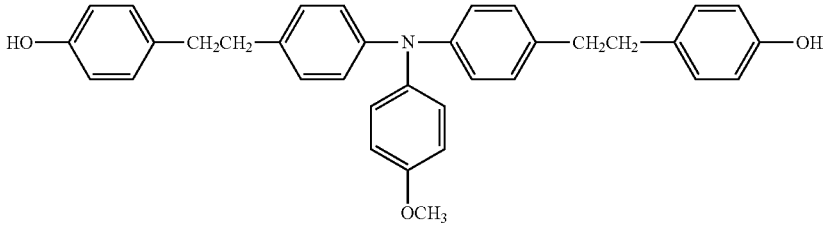
(6-14)
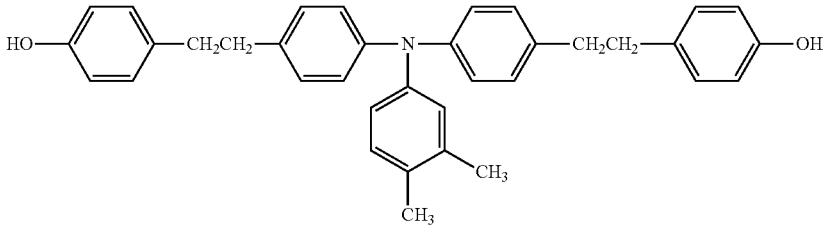
(6-15)
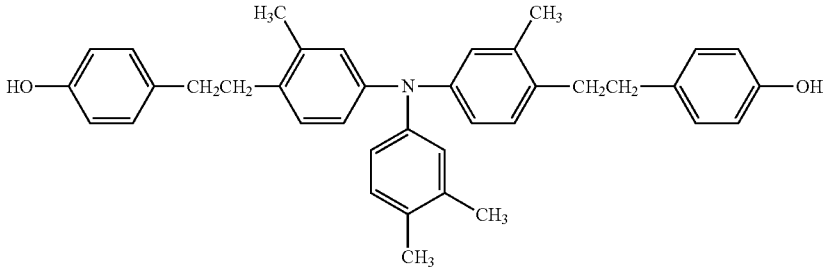
(6-16)
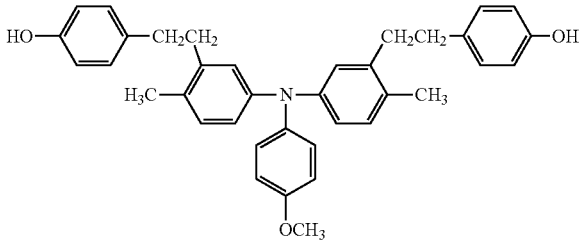
(6-17)
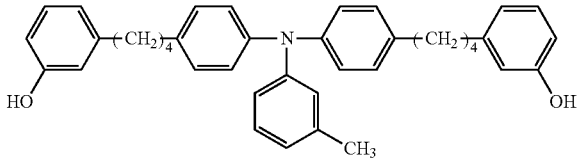

-continued (6-18)

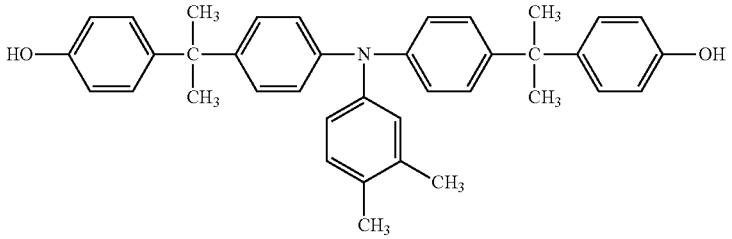

(6-19)

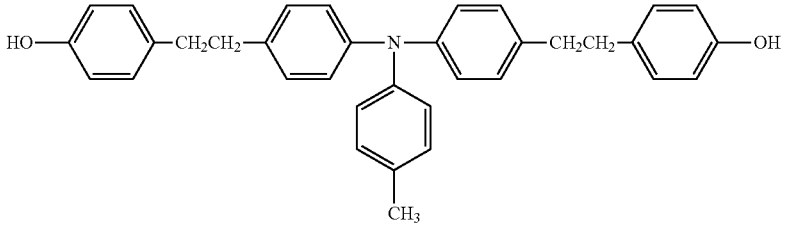

(6-20)

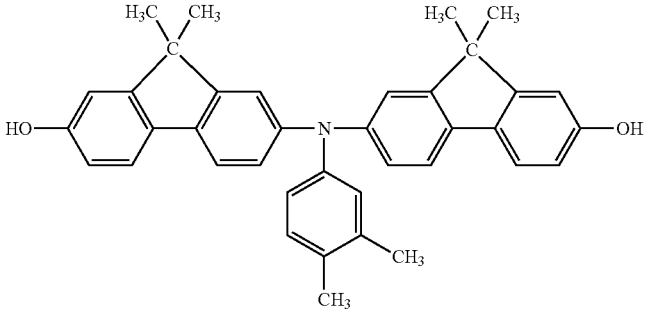

From the viewpoints of improvements in wear resistance and image unevenness, it is preferred that the composition containing the charge-transportable monomer further contain at least one kind selected from a guanamine compound and a melamine compound each having a hydroxyalkyl group or a hydroxyalkoxy group.

The guanamine compound is, among diaminotriazines, a compound having at least one hydroxyalkyl group or hydroxyalkoxy group as a substituent on its amino groups.

The melamine compound is, among triaminotriazines, a compound having at least one hydroxyalkyl group or hydroxyalkoxy group as a substituent on its amino groups.

Examples thereof include Nikalac BL-60, Nikalac BX-4000, and Nikalac MW-30 manufactured by Nippon Carbide Industries Co., Inc., U-VAN 2020 manufactured by Mitsui Chemicals, Inc., and the AMIDIR series manufactured by DIC Corporation.

From the viewpoint of an improvement in image unevenness, it is preferred that the surface layer contain: the cured product of the composition containing the charge-transportable monomer; and fluorine atom-containing resin particles. Examples of the fluorine atom-containing resin particles include particles of a tetrafluoroethylene resin, a trifluoroethylene resin, a tetrafluoroethylene-hexafluoropropylene resin, a vinyl fluoride resin, a vinylidene fluoride resin, and a difluorodichloroethylene resin, and particles of copolymers of those resins. In particular, particles of a tetrafluoroethylene resin are preferred. The average particle diameter of primary particles of the fluorine atom-containing resin particles is preferably 0.5 μm or less, more preferably 0.3 μm or less.

From the viewpoint of an improvement in residual potential, it is preferred that the content ratio of the charge-transportable monomer with respect to the composition containing the charge-transportable monomer be 50 mass % or more. When the residual potential is thus improved, the degree of freedom in design of each of an electrophotographic photosensitive member, and a process cartridge and an electrophotographic apparatus each using the electrophotographic photosensitive member can be increased, and as a result, reductions in production cost and printing cost, and an improvement in image quality can be achieved.

As a method of subjecting the reactive functional group to a polymerization reaction, there may be used a method involving applying energy, such as UV light, an electron beam, or heat, or a method involving causing an auxiliary agent, such as a polymerization initiator, and a compound, such as an acid, an alkali, or a complex, to coexist.

[Electrophotographic Photosensitive Member]

The electrophotographic photosensitive member according to at least one embodiment of the present disclosure has a feature of including a photosensitive layer and a surface layer.

A method of producing the electrophotographic photosensitive member according to at least one embodiment of the present disclosure is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<Support>

In at least one embodiment of the present disclosure, the electrophotographic photosensitive member includes the support. In at least one embodiment of the present disclosure, the support is preferably a conductive support having conductivity. In addition, examples of the shape of the support include a cylindrical shape, a belt shape, and a sheet shape. Of those, a cylindrical support is preferred. In addition, the surface of the support may be subjected to, for example, electrochemical treatment, such as anodization, blast treatment, or cutting treatment.

A metal, a resin, glass, or the like is preferred as a material for the support.

Examples of the metal include aluminum, iron, nickel, copper, gold, stainless steel, and alloys thereof. Of those, an aluminum support using aluminum is preferred.

In addition, conductivity may be imparted to the resin or the glass through treatment involving, for example, mixing or coating the resin or the glass with a conductive material.

<Conductive Layer>

In at least one embodiment of the present disclosure, the conductive layer may be arranged on the support. The arrangement of the conductive layer can conceal flaws and irregularities in the surface of the support, and control the reflection of light on the surface of the support.

The conductive layer preferably contains conductive particles and a resin.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

The conductive layer has an average thickness of preferably 1 μm or more and 50 μm or less, particularly preferably 3 μm or more and 40 μm or less.

The conductive layer may be formed by preparing a coating liquid for a conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Undercoat Layer>

In at least one embodiment of the present disclosure, the undercoat layer may be arranged on the support or the conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a reactive functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the reactive functional group of the monomer having a reactive functional group include an isocyanate group, a blocked isocyanate group, a methylol group, an alkylated methylol group, an epoxy group, a metal alkoxide group, a hydroxyl group, a methoxy group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a reactive functional group may be used as the electron-transporting substance and copolymerized with the above-mentioned monomer having a reactive functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The undercoat layer has an average thickness of preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

(1) Laminated Photosensitive Layer

The laminated photosensitive layer includes the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.1 μm or more and 1 μm or less, more preferably 0.15 μm or more and 0.4 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by preparing a coating liquid for a photosensitive layer containing the charge-generating substance, the charge-transporting substance, a resin, and a solvent, forming a coat thereof, and drying the coat. Examples of the charge-generating substance, the charge-transporting substance, and the resin are the same as those of the materials in the section "(1) Laminated Photosensitive Layer."

<Protective Layer>

In at least one embodiment of the present disclosure, a protective layer may be arranged on the photosensitive layer. The arrangement of the protective layer can improve durability.

The protective layer preferably contains the conductive particles and/or the charge-transporting substance, and a resin.

Examples of the conductive particles include particles of metal oxides, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

In addition, the protective layer may be formed as a cured film by polymerizing a composition containing a monomer having a reactive functional group. As a reaction in this case, there are given, for example, a thermal polymerization reaction, a photopolymerization reaction, and a radiation polymerization reaction. Examples of the reactive functional group of the monomer having a reactive functional group include an acrylic group, a methacrylic group, a hydroxy group, a hydroxyalkyl group, a hydroxyalkoxy group, a hydroxyphenyl group, a thiol group, a methoxy group, an amino group, and a carboxyl group. A material having a charge-transporting ability may be used as the monomer having a reactive functional group.

The protective layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer has an average thickness of preferably 0.5 μm or more and 10 μm or less, more preferably 1 μm or more and 7 μm or less.

The protective layer may be formed by preparing a coating liquid for a protective layer containing the above-mentioned materials and a solvent, forming a coat thereof, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

<Surface Layer>

As described above, the layer serving as the surface layer is formed of the cured product of the composition containing the compound represented by the formula (A) and the charge-transporting substance having at least one group selected from the group consisting of a hydroxy group, a methoxy group, an amino group, a thiol group, and a carboxyl group.

The surface layer of the electrophotographic photosensitive member according to at least one embodiment of the present disclosure is any one of: the above-mentioned protective layer; the charge-transporting layer of a laminated photosensitive member free of the protective layer; and the photosensitive layer of a single-layer photosensitive member free of the protective layer. As long as the layer serving as the surface layer is formed of the cured product of the composition described above, the layer may further contain materials described in the foregoing sections "(1-2) Charge-transporting Layer", "(2) Single-layer Photosensitive Layer", and "<Protective Layer>".

[Process Cartridge and Electrophotographic Apparatus]

A process cartridge according to at least one embodiment of the present disclosure has a feature of integrally supporting the electrophotographic photosensitive member described in the foregoing, and at least one unit selected from the group consisting of a charging unit, a developing unit, and a cleaning unit, and being removably mounted onto the main body of an electrophotographic apparatus.

In addition, an electrophotographic apparatus according to at least one embodiment of the present disclosure has a feature of including the electrophotographic photosensitive member described in the foregoing, a charging unit, an exposing unit, a developing unit, and a transferring unit.

An example of the schematic construction of an electrophotographic apparatus including a process cartridge including an electrophotographic photosensitive member is illustrated in FIGURE.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging unit 3. In FIGURE, a roller charging system based on a roller-type charging member is illustrated, but a charging system such as a corona charging system, a proximity charging system, or an injection charging system may be adopted. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to electricity-removing treatment with pre-exposure light 10 from a pre-exposing unit (not shown). In addition, a guiding unit 12, such as a rail, may be arranged for removably mounting a process cartridge 11 according to at least one embodiment of the present disclosure onto the main body of an electrophotographic apparatus.

The electrophotographic photosensitive member according to at least one embodiment of the present disclosure can be used in, for example, a laser beam printer, an LED printer, a copying machine, a facsimile, and a multifunctional peripheral thereof.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

<Production of Electrophotographic Photosensitive Member>

<Support>

A cylinder made of cylindrical aluminum having a diameter of 29.9 mm, a length of 357.5 mm, and a thickness of 0.7 mm was used as a support.

<Undercoat Layer>

100 Parts of zinc oxide particles (specific surface area: 19 $m^2/g$, powder resistivity: $4.7\times10^6$ Ω·cm) serving as a metal oxide were mixed with 500 parts of toluene under stirring. To the mixture, 0.8 part of N-2-(aminoethyl)-3-aminopropylmethyldimethoxysilane (product name: KBM602, manufactured by Shin-Etsu Chemical Co., Ltd.) was added as a silane coupling agent, and the whole was stirred for 6 hours. After that, toluene was evaporated under reduced pressure, and the residue was dried by heating at 140° C. for 6 hours to provide surface-treated zinc oxide particles.

Next, 15 parts of polyvinyl butyral (product name: S-LEC (trademark) B BM-1, manufactured by Sekisui Chemical Co., Ltd.) and 15 parts of a blocked isocyanate (product name: Sumidur 3175, manufactured by Sumitomo Bayer Urethane Co., Ltd.) were dissolved in a mixed solution. The mixed solution is a mixed solution of 73.5 parts of methyl ethyl ketone and 73.5 parts of 1-butanol.

To the resultant solution, 80.8 parts of the surface-treated zinc oxide particles prepared above and 0.4 part of 2,3,4-trihydroxybenzophenone (manufactured by Tokyo Chemical Industry Co., Ltd.) were added, and the mixture was dispersed under an atmosphere at 23° C. for 3 hours using a sand mill apparatus using glass beads each having a diameter of 0.8 mm. After the dispersion, 0.01 part of a silicone oil (product name: SH28PA, manufactured by Dow Corning Toray Co., Ltd.) and 5.6 parts of crosslinked polymethyl methacrylate (PMMA) particles (product name: TECHPOLYMER (trademark) SSX-103, manufactured by Sekisui Plastics Co., Ltd., average primary particle diameter: 3.1 μm) were added, and the whole was stirred to prepare a coating liquid for an undercoat layer.

The coating liquid for an undercoat layer was applied onto the above-mentioned support by dip coating, and the resultant coat was dried at 160° C. for 40 minutes to form an undercoat layer having a thickness of 18

<Charge-Generating Layer>

Four materials described below were placed in a sand mill using glass beads each having a diameter of 1 mm, and were subjected to dispersion treatment for 4 hours, and then 700 parts of ethyl acetate was added to prepare a coating liquid for a charge-generating layer.

Hydroxygallium phthalocyanine crystal of a crystal form having strong peaks at Bragg angels 20±0.2° in CuKα characteristic X-ray diffraction of 7.4° and 28.2° (charge-generating substance): 20 parts Polyvinyl butyral (product name: S-LEC (trademark) B BX-1, manufactured by Sekisui Chemical Co., Ltd.): 10 parts Compound represented by the following structural formula (G): 0.2 part Cyclohexanone: 600 parts The coating liquid for a charge-generating layer was applied onto the undercoat layer by dip coating, and the resultant coat was dried at 80° C. for 15 minutes to form a charge-generating layer having a thickness of 0.18 μm.

(G)

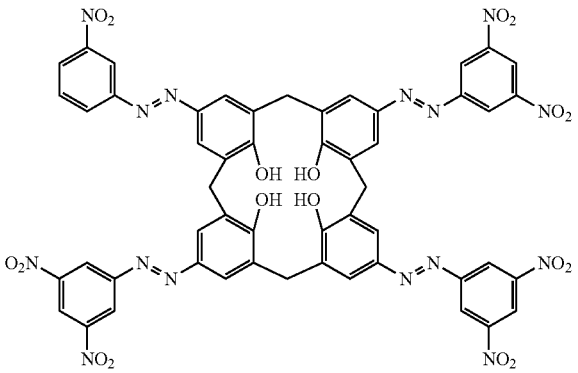

<Charge-Transporting Layer>

The following materials were dissolved in a mixed solvent of 600 parts of xylene and 200 parts of dimethoxymethane to prepare a coating liquid for a charge-transporting layer.

Compound represented by the following structural formula (B) (charge-transporting substance): 30 parts Compound represented by the following structural formula (C) (charge-transporting substance): 60 parts Compound represented by the following structural formula (D) (charge-transporting substance): 10 parts Compound represented by the following structural formula (E) (Mv: 20,000): 0.02 part Polycarbonate (product name: Iupilon (trademark) Z400, manufactured by Mitsubishi Engineering-Plastics Corporation, bisphenol Z-type polycarbonate): 100 parts (B)

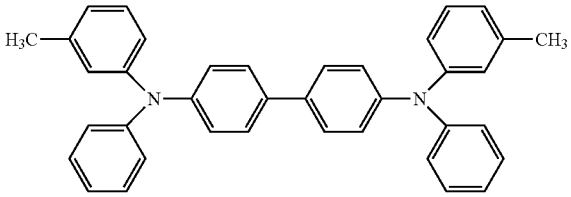

(C)

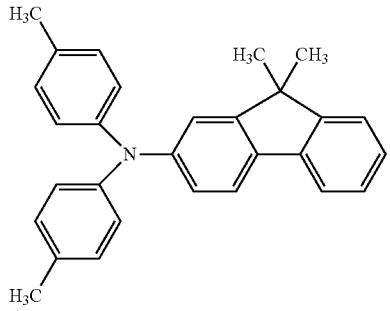

(D)

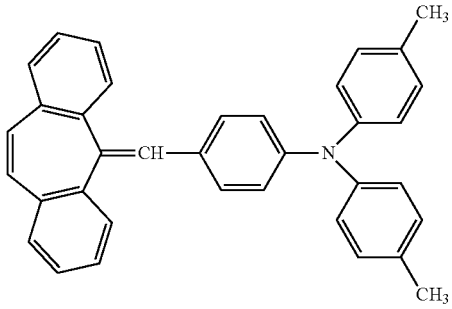

(E)

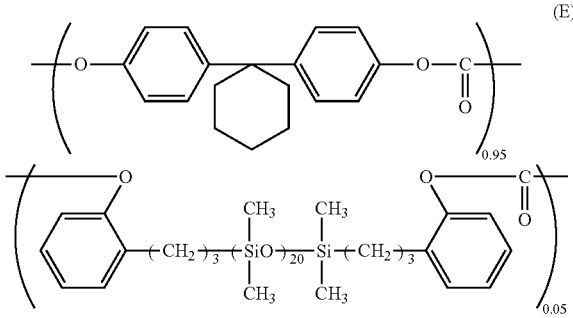

The coating liquid for a charge-transporting layer was applied onto the charge-generating layer by dip coating, and the resultant coat was dried at 110° C. for 30 minutes to form a charge-transporting layer having a thickness of 18 μm.

<Surface Layer>

Next, a coating liquid for a surface layer was produced using materials selected from the following group of materials.

Exemplary compound represented by the formula (A-5) (dioxane glycol manufactured by Mitsubishi Gas Chemical Company, Inc.)

(A-5)

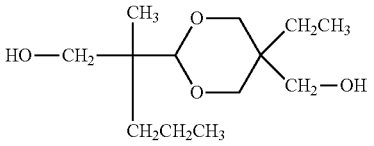

Charge-transportable monomer represented by the formula (H) (compound H)

(H)

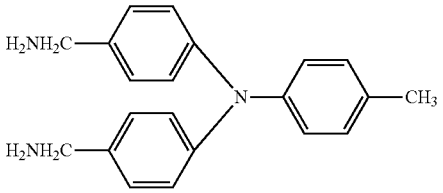

Charge-transportable monomer represented by the formula (I) (compound I)

(I)

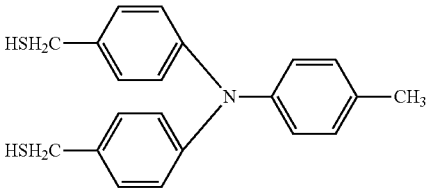

Charge-transportable monomer represented by the formula (J) (compound J)

(J)

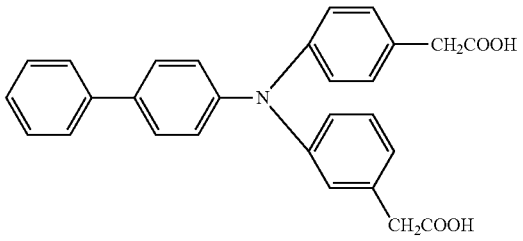

Charge-transportable monomer represented by the formula (K) (compound K)

(K)

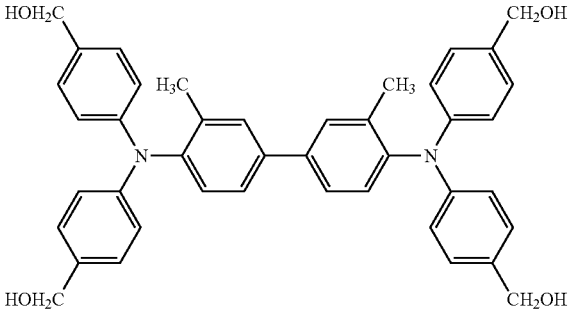

Guanamine compound represented by the following structural formula (product name: Nikalac BL-60, manufactured by Nippon Carbide Industries Co., Inc.)

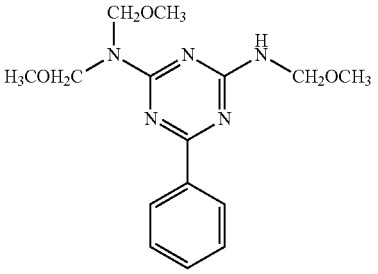

Catalyst; p-toluenesulfonic acid

Fluorine atom-containing resin particles; polytetrafluoroethylene particles (product name: Lubron L-2, manufactured by Daikin Industries, Ltd.)

Dispersant; resin having a repeating structural unit represented by the following structural formula (F1) and a repeating structural unit represented by the following structural formula (F2) (weight-average molecular weight: 83,000, copolymerization ratio (F1)/(F2)=1/1 (molar ratio))

(F1)

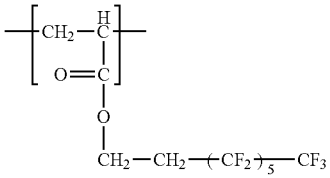

(F2)

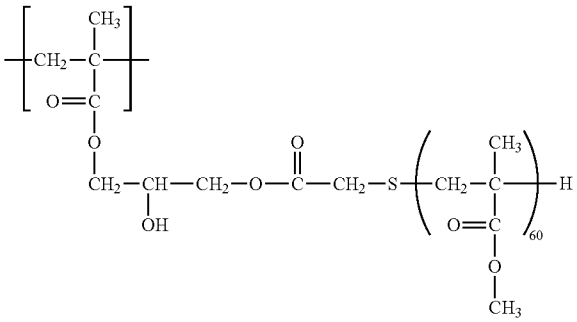

First, the exemplary compound represented by the formula (A-5), the charge-transportable monomer, and the guanamine compound in the numbers of parts by mass shown in Table 1 were mixed with 100 parts by mass of cyclopentanone under stirring to provide a mixed liquid. Next, the fluorine atom-containing resin particles (resin particles) and the dispersant in the numbers of parts by mass shown in Table 1 were mixed with 100 parts by mass of cyclopentanone under stirring, and the mixture was subjected to high-pressure dispersion with a high-pressure dispersion machine (product name: Microfluidizer M-110EH, manufactured by Microfluidics, USA) to provide a dispersion liquid. The resultant mixed liquid and dispersion liquid, and p-toluenesulfonic acid (catalyst) were stirred and mixed to provide a coating liquid for a surface layer. When the dispersion liquid was not used, the number of parts by mass of cyclopentanone to be used for the mixed liquid was changed to 200. In Table 1, a material at 0 parts by mass shows that the material was not used. Thus, a coating liquid for a surface layer was prepared.

Such coating liquid for a surface layer was applied onto the charge-transporting layer by dip coating. The resultant coat was dried at 150° C. for 60 minutes to form a surface layer having a thickness of 5

Thus, electrophotographic photosensitive members 1 to 13 shown in Table 1 were produced. In Table 1, a content ratio represents the ratio of the mass of the charge-transportable monomer to the sum of the masses of the exemplary compound represented by the formula (A-5), the charge-transportable monomer, and the guanamine compound.

TABLE 1

| Electrophotographic photosensitive member | Exemplary compound (A-5) (part(s)) | Charge-transportable monomer (part(s)) | Guanamine compound (part(s)) | Catalyst (part(s)) | Resin particles (part(s)) | Dispersant (part(s)) | Content ratio |
|---|---|---|---|---|---|---|---|
| 1 | 90 | Compound H (10) | 0 | 0 | 0 | 0 | 10% |
| 2 | 90 | Compound I (10) | 0 | 0 | 0 | 0 | 10% |
| 3 | 90 | Compound J (10) | 0 | 0 | 0 | 0 | 10% |
| 4 | 90 | Compound K (10) | 0 | 0 | 0 | 0 | 10% |
| 5 | 80 | Compound K (20) | 0 | 0 | 0 | 0 | 20% |
| 6 | 50 | Compound K (50) | 0 | 0 | 0 | 0 | 50% |
| 7 | 20 | Compound K (80) | 0 | 0 | 0 | 0 | 80% |
| 8 | 20 | Compound K (70) | 10 | 0.1 | 0 | 0 | 70% |
| 9 | 20 | Compound K (70) | 0 | 0 | 10 | 0.5 | 78% |
| 10 | 20 | Compound K (70) | 5 | 0.1 | 5 | 0.25 | 74% |
| 11 | 0 | Compound K (100) | 0 | 0 | 0 | 0 | 100% |
| 12 | 0 | Compound K (70) | 30 | 0.1 | 0 | 0 | 70% |
| 13 | 0 | Compound K (70) | 15 | 0.1 | 15 | 0.75 | 82% |

[Evaluations]

<Image Unevenness Evaluation>

A history was imparted to an electrophotographic photosensitive member using a photosensitive member test apparatus (product name: CYNTHIA59, manufactured by Gentec Co., Ltd.), and then an image was output with a copying machine and evaluated for image unevenness.

Specifically, the electrophotographic photosensitive member was mounted onto the photosensitive member test apparatus, and charging and exposure were repeated for 1,000 rotations under the following conditions. After the charging, the exposure, and the rotation had been stopped, the whole was left to stand still for 24 hours while the corona charger and the electrophotographic photosensitive member were opposed to each other.

Environment; temperature: 23° C., humidity: 5% RH

Charging; corona charger, set so that the electrophotographic photosensitive member had a surface potential of −700 V Exposure; LED having a wavelength of 780 nm, light quantity: 20 ($\mu J/cm^2$)

Next, the electrophotographic photosensitive member was removed from the photosensitive member test apparatus and mounted onto a cyan station of a copying machine available under the product name iR-ADVC5560 from Canon Inc., and a halftone image was output under an environment having a temperature of 23° C. and a relative humidity of 5%. A density difference between part of the resultant image that had been opposed to the corona charger during the standing still and part thereof that had not been opposed to the corona charger was measured with a spectral densitometer (product name: X-rite 504, manufactured by X-rite Inc.).

<Evaluation of Wear Resistance>

Wear resistance was evaluated using a copying machine available under the product name iR-ADVC5560 from Canon Inc.

Specifically, an electrophotographic photosensitive member was mounted onto a cyan station of the copying machine, and under an environment at 23° C. and 5% RH, a chart having a print percentage of 5% was output on 30,000 sheets. After that, cyan (single color) and green (mixed color of cyan and yellow) halftones were output, and the degree of appearance of a flaw of the electrophotographic photosensitive member on the images was evaluated. Even a slighter flaw is liable to be visually recognized on an image in green than in cyan. Evaluation ranks were set as described below.

A A flaw image occurred in neither cyan nor green.

B A flaw image occurred only in green.

C Flaw images occurred in both cyan and green.

<Residual Potential>

Residual potential (V) was evaluated with a photosensitive member test apparatus (product name: CYNTHIA59, manufactured by Gentec Co., Ltd.) under the following conditions.

Environment; temperature: 23° C., relative humidity: 50%

Charging; corona charger, set so that the electrophotographic photosensitive member had a surface potential of −700 V Exposure; LED having a wavelength of 780 nm, light quantity: 20 ($\mu J/cm^2$)

Examples 1 to 10

The above-mentioned evaluations of image unevenness, wear resistance, and residual potential were performed using each of the electrophotographic photosensitive members 1 to 10. The results are shown in Table 2.

Comparative Examples 1 to 3

The above-mentioned evaluations of image unevenness, wear resistance, and residual potential were performed using each of the electrophotographic photosensitive members 11 to 13. The results are shown in Table 2.

TABLE 2

| | Electrophotographic photosensitive member | Image unevenness | Wear resistance Flaw image | Residual potential (V) |
|---|---|---|---|---|
| Example 1 | 1 | 0 | B | 85 |
| Example 2 | 2 | 0 | B | 80 |
| Example 3 | 3 | 0 | B | 85 |
| Example 4 | 4 | 0 | A | 85 |
| Example 5 | 5 | 0 | A | 80 |
| Example 6 | 6 | 0 | A | 65 |
| Example 7 | 7 | 0.005 | A | 55 |
| Example 8 | 8 | 0 | A | 60 |
| Example 9 | 9 | 0 | B | 70 |
| Example 10 | 10 | 0 | A | 65 |
| Comparative Example 1 | 11 | 0.04 | C | 50 |
| Comparative Example 2 | 12 | 0.04 | A | 60 |
| Comparative Example 3 | 13 | 0.03 | B | 70 |

As apparent from the foregoing, the photosensitive member according to at least one embodiment of the present disclosure can achieve improvements both in wear resistance and in image unevenness.

According to at least one embodiment of the present disclosure, the electrophotographic photosensitive member improved both in wear resistance and in image unevenness can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-138967, filed Jul. 29, 2019, which is hereby incorporated by reference herein in its entirety.

What is claimed is:

1. An electrophotographic photosensitive member comprising:

a support;

a photosensitive layer; and a surface layer, the photosensitive layer and the surface layer being arranged on the support, wherein the surface layer is a cured product of a composition containing:

a compound represented by the formula (A); and a charge-transporting substance having at least one reactive functional group selected from the group consisting of a hydroxy group, a methoxy group, an amino group, a thiol group, and a carboxyl group:

(A)

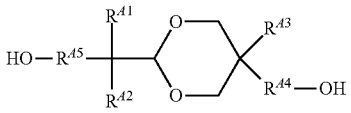

in the formula (A), $R^{A1}$ and $R^{A2}$ each independently represent an alkyl group having 1 or more and 4 or less carbon atoms, or a substituted or unsubstituted phenyl group, $R^{A1}$ and $R^{A2}$ may be bonded to each other to form a ring, $R^{A3}$ represents an alkyl group having 1 or more and 4 or less carbon atoms, and $R^{A4}$ and $R^{A5}$ each represent an alkylene group having 1 or more and 4 or less carbon atoms.

2. The electrophotographic photosensitive member according to claim 1, wherein the charge-transporting substance has at least one group selected from a hydroxyalkyl group, a hydroxyalkoxy group, and a hydroxyphenyl group that may have a substituent.

3. The electrophotographic photosensitive member according to claim 1, wherein the composition further contains at least one kind selected from a guanamine compound and a melamine compound each having one of a hydroxyalkyl group and a hydroxyalkoxy group.

4. The electrophotographic photosensitive member according to claim 1, wherein the surface layer contains the cured product of the composition, and fluorine atom-containing resin particles.

5. The electrophotographic photosensitive member according to claim 1, wherein a content ratio of the charge-transporting substance with respect to the composition is 50 mass % or more.

6. A process cartridge comprising:

an electrophotographic photosensitive member; and at least one unit selected from the group consisting of a charging unit, a developing unit, and a cleaning unit, the process cartridge integrally supporting the electrophotographic photosensitive member and the at least one unit, and being removably mounted onto a main body of an electrophotographic apparatus, wherein the electrophotographic photosensitive member includes a support, and a photosensitive layer and a surface layer on the support, and wherein the surface layer is a cured product of a composition containing:

a compound represented by the formula (A); and a charge-transporting substance having at least one reactive functional group selected from the group consisting of a hydroxy group, a methoxy group, an amino group, a thiol group, and a carboxyl group:

(A)

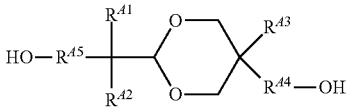

in the formula (A), $R^{A1}$ and $R^{A2}$ each independently represent an alkyl group having 1 or more and 4 or less carbon atoms, or a substituted or unsubstituted phenyl group, $R^{A1}$ and $R^{A2}$ may be bonded to each other to form a ring, $R^{A3}$ represents an alkyl group having 1 or more and 4 or less carbon atoms, and $R^{A4}$ and $R^{A5}$ each represent an alkylene group having 1 or more and 4 or less carbon atoms.

7. An electrophotographic apparatus comprising:

an electrophotographic photosensitive member comprising;

a charging unit;

an exposing unit;

a developing unit; and a transferring unit, wherein the electrophotographic photosensitive member includes a support, and a photosensitive layer and a surface layer on the support, and wherein the surface layer is a cured product of a composition containing:

a compound represented by the formula (A); and a charge-transporting substance having at least one reactive functional group selected from the group consisting of a hydroxy group, a methoxy group, an amino group, a thiol group, and a carboxyl group:

(A)

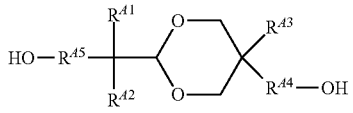

in the formula (A), $R^{A1}$ and $R^{A2}$ each independently represent an alkyl group having 1 or more and 4 or less carbon atoms, or a substituted or unsubstituted phenyl group, $R^{A1}$ and $R^{A2}$ may be bonded to each other to form a ring, $R^{A3}$ represents an alkyl group having 1 or more and 4 or less carbon atoms, and $R^{A4}$ and $R^{A5}$ each represent an alkylene group having 1 or more and 4 or less carbon atoms.

* * * * *